US010876818B2

(12) United States Patent
Tamir

(10) Patent No.: US 10,876,818 B2
(45) Date of Patent: Dec. 29, 2020

(54) FIREARM TRAINING SYSTEMS AND METHODS

(71) Applicant: Modular High-End LTD., Herzliya (IL)

(72) Inventor: Gal Tamir, Herzliya (IL)

(73) Assignee: Modular High-End LTD., Herzliya (IL)

( * ) Notice: Subject to any disclaimer, the term of this patent is extended or adjusted under 35 U.S.C. 154(b) by 0 days.

(21) Appl. No.: 16/858,761

(22) Filed: Apr. 27, 2020

(65) Prior Publication Data

US 2020/0256642 A1 Aug. 13, 2020

Related U.S. Application Data

(63) Continuation-in-part of application No. 16/036,963, filed on Jul. 17, 2018, now Pat. No. 10,670,373, which is a continuation of application No. 15/823,634, filed on Nov. 28, 2017, now Pat. No. 10,077,969.

(51) Int. Cl.

| | |
|---|---|
| ***F41G 3/26*** | (2006.01) |
| ***F41J 5/10*** | (2006.01) |
| ***F41J 5/08*** | (2006.01) |
| ***F41J 7/00*** | (2006.01) |

(52) U.S. Cl.

CPC ..... *F41G 3/2605* (2013.01); *F41G 3/2627* (2013.01); *F41G 3/2655* (2013.01); *F41G 3/2694* (2013.01); *F41J 5/08* (2013.01); *F41J 5/10* (2013.01); *F41J 7/00* (2013.01)

(58) Field of Classification Search

CPC ..... F41G 3/26; F41G 3/2605; F41G 3/2627; F41G 3/2644; F41G 3/2655; F41G 3/2677; F41J 5/10; F41J 7/00; F41A 33/00; F41A 33/02; F41A 33/04; F41A 33/06

See application file for complete search history.

(56) References Cited

U.S. PATENT DOCUMENTS

| | | | | |
|---|---|---|---|---|
| 9,360,283 | B1 * | 6/2016 | Tejada | F41J 1/00 |
| 9,618,301 | B2 * | 4/2017 | Wichner | F41A 17/08 |
| 2007/0238073 | A1 * | 10/2007 | Portoghese | F41G 3/2605 434/21 |
| 2010/0092925 | A1 * | 4/2010 | Lvovskiy | F41J 5/10 434/22 |
| 2017/0321987 | A1 * | 11/2017 | Apkarian | F41G 3/2627 |

* cited by examiner

*Primary Examiner* — Timothy A Musselman
(74) *Attorney, Agent, or Firm* — Mark M. Friedman

(57) ABSTRACT

A system has at least one processor, a control subsystem, and an end unit with at least one image sensor. The control subsystem switches operation of the system between first and second modes. In the first mode, an image sensor captures a visible light image of a scene, and a processor analyzes the visible light image to identify a target in the scene and extract target spatial information. In the second mode, an image sensor captures a series of IR images of the scene, and a processor analyzes the IR images to identify firearm projectile strikes on the target based on the extracted spatial information and comparisons between the IR images. In certain embodiments, the same image sensor is used for visible light and IR image, and an IR filter is selectively positioned in an optical path from the scene to the image sensor according to the mode of operation.

20 Claims, 18 Drawing Sheets

FIREARM TRAINING SYSTEMS AND METHODS

CROSS-REFERENCE TO RELATED APPLICATIONS

This application is a continuation-in-part of U.S. patent application Ser. No. 16/036,963, filed on Jul. 17, 2018, now U.S. Pat. No. 10,670,373, which is a continuation of U.S. patent application Ser. No. 15/823,634, filed on Nov. 28, 2017, now U.S. Pat. No. 10,077,969. The disclosures of the aforementioned applications are incorporated by reference in their entirety herein.

TECHNICAL FIELD

The present invention relates to firearm target training.

BACKGROUND OF THE INVENTION

Firearm target training systems are generally used to provide firearm weapons training to a user or trainee. Traditionally, the user is provided with a firearm and discharges the firearm while aiming at a target, in the form of a bullseye made from paper or plastic. These types of training environments provide little feedback to the user, in real-time, as they require manual inspection of the bullseye to evaluate user performance.

More advanced training systems include virtual training scenarios, and rely on modified firearms, such as laser-based firearms, to train law enforcement officers and military personnel. Such training systems lack modularity and require significant infrastructural planning in order to maintain training efficacy.

SUMMARY OF THE INVENTION

The present invention is a system and corresponding components for providing functionality for firearm training.

According to the teachings of an embodiment of the present invention, there is provided a firearm training system. The firearm training system comprises: an end unit comprising an imaging device for capturing images of a scene, the imaging device having an image sensor and at least one lens defining an optical path from the scene to the image sensor, and the end unit being positionable against a target; at least one processor operatively coupled to the end unit; an infrared filter; a positioning mechanism operatively coupled to the infrared filter, the positioning mechanism configured to position the infrared filter in and out of the optical path; and a control subsystem linked to the end unit, the at least one processor, and the positioning mechanism. The control subsystem is configured to control the end unit, the at least one processor, and the positioning mechanism to effect switching of the firearm training system between a first mode and a second mode. In the first mode, in response to actuation by the control subsystem: the positioning mechanism positions the infrared filter out of the optical path, the imaging device captures at least one image of the scene, and the at least one processor analyzes the at least one image of the scene captured by the imaging device to identify the target in the at least one captured image and to extract spatial information associated with the target. In the second mode, in response to actuation by the control subsystem: the positioning mechanism positions the infrared filter in the optical path, the imaging device captures a series of images of the scene with the infrared filter positioned in the optical path, and the at least one processor analyzes the captured series of images of the scene to identify firearm projectile strikes on the target based in part on: comparisons between images from the series of images, and the extracted spatial information.

Optionally, the target is a physical target.

Optionally, the end unit is positionable against a background having images displayed thereon corresponding to at least one virtual target.

Optionally, the positioning mechanism is configured to position the infrared filter between the scene and the at least one lens.

Optionally, the positioning mechanism is configured to position the infrared filter between the at least one lens and the image sensor.

Optionally, the positioning mechanism generates circular to linear motion for moving the infrared filter in and out of the optical path.

Optionally, the firearm training system further comprises: a guiding arrangement in operative cooperation with the infrared filter and defining a guide path along which the infrared filter is configured to move, such that the infrared filter is guided along the guide path and passes in front of the at least one lens so as to be positioned in the optical path when the positioning mechanism is actuated by the control subsystem.

Optionally, the firearm projectiles are live ammunition projectiles.

Optionally, the firearm projectiles are light beams emitted by a light source emanating from a firearm.

Optionally, the end unit includes the at least one processor.

Optionally, the at least one processor is deployed as part of a server remotely located from the end unit and linked to the end unit over a network.

Optionally, the control subsystem is configured to display the identified target in the at least one image of the scene captured by the imaging device in the first mode, and is further configured to overlay information, extracted from the series of images captured by the imaging device in the second mode, on the displayed identified target in the at least one image of the scene.

There is also provided according to an embodiment of the teachings of the present invention a firearm training system. The firearm training system comprises: an end unit comprising a first image sensor for capturing at least a visible light image of a scene, and a second image sensor for capturing an infrared image of the scene, the end unit being positionable against a target; at least one processor operatively coupled to the end unit; and a control subsystem linked to the end unit and the at least one processor. The control subsystem is configured to control the end unit and the at least one processor to effect switching of the firearm training system between a first mode and a second mode. In the first mode, in response to actuation by the control subsystem: the first image sensor captures at least one visible light image of the scene, and the at least one processor analyzes the at least one image of the scene captured by the image sensor to identify the target in the at least one captured image and to extract spatial information associated with the target. In the second mode, in response to actuation by the control subsystem: the second image sensor captures a series of infrared images of the scene, and the at least one processor analyzes the captured series of infrared images of the scene to identify firearm projectile strikes on the target based in part on: comparisons between infrared images from the series of infrared images, and the extracted spatial information.

Optionally, the firearm projectiles are live ammunition projectiles.

Optionally, the firearm projectiles are light beams emitted by a light source emanating from a firearm.

Optionally, the at least one processor is deployed as part of a server remotely located from the end unit and in communication with the end unit over a network.

There is also provided according to an embodiment of the teachings of the present invention a firearm training method. The firearm training method comprises: deploying at least one image sensor relative to a target; capturing, by at least one image sensor, at least one visible light image of a scene; analyzing, by at least one processor, the at least one image of the scene captured by the at least one image sensor to identify the target in the at least one captured image of the scene and to extract spatial information associated with the target; capturing a series of infrared images of the scene; and analyzing, by the at least one processor, the captured series of infrared images of the scene to identify projectile strikes on the target based in part on: comparisons between infrared images from the series of infrared images, and the extracted spatial information.

Optionally, the firearm training method further comprises: displaying the identified target; and overlaying information, extracted from the captured series of infrared images, on the displayed identified target.

Optionally, the at least one image sensor includes a first image sensor for capturing at least visible light images of the scene, and a second image sensor for capturing infrared images of the scene, and the series of infrared images of the scene are captured by the second image sensor.

Optionally, the at least one image sensor includes exactly one image sensor that is sensitive to light in the visible region and infrared region of the electromagnetic spectrum and that is part of an imaging device having at least one lens defining an optical path from the scene to the image sensor, and the firearm training method further comprises: positioning an infrared filter in the optical path prior to capturing the series of infrared images.

Unless otherwise defined herein, all technical and/or scientific terms used herein have the same meaning as commonly understood by one of ordinary skill in the art to which the invention pertains. Although methods and materials similar or equivalent to those described herein may be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the present invention are herein described, by way of example only, with reference to the accompanying drawings. With specific reference to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

Attention is now directed to the drawings, where like reference numerals or characters indicate corresponding or like components. In the drawings.

DESCRIPTION OF THE PREFERRED EMBODIMENTS

Figure 1:
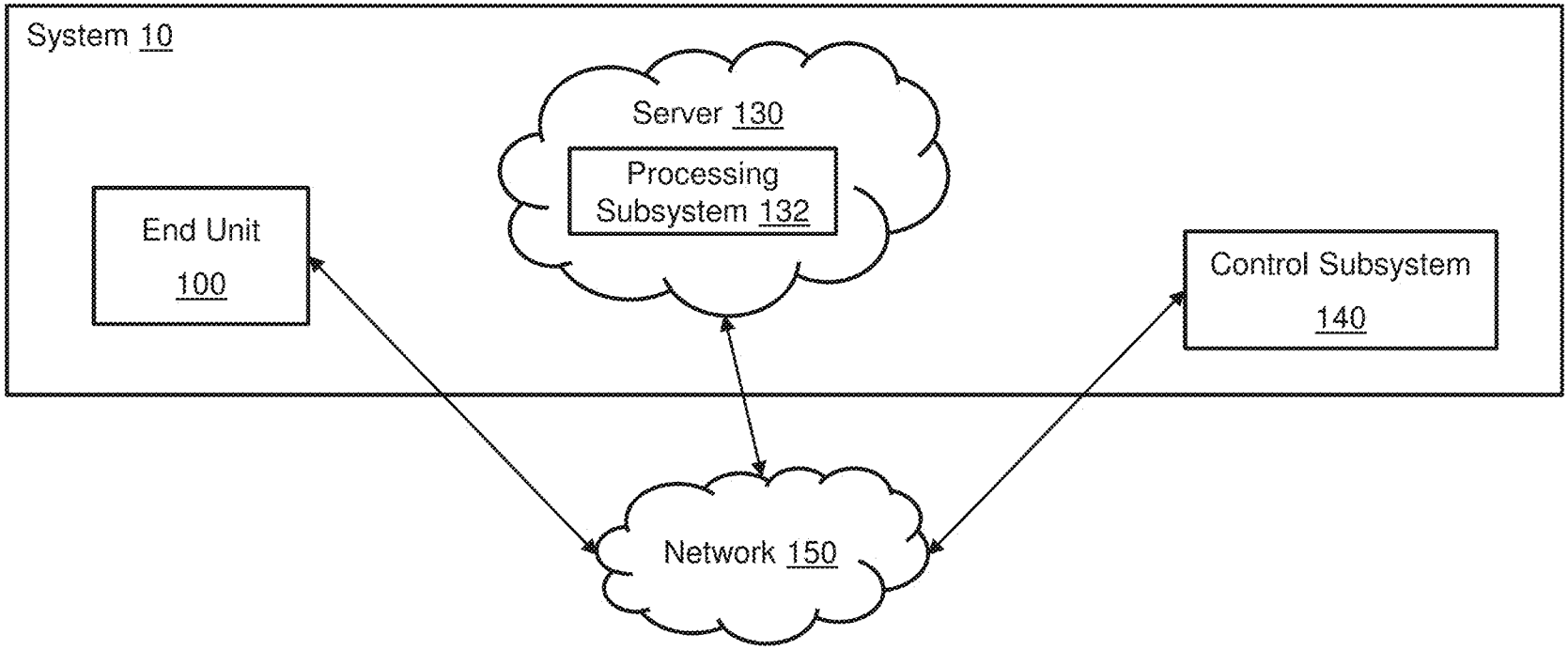
FIG. 1 is a diagram illustrating an environment in which a system according to an embodiment of the invention is deployed, the system including an end unit, a processing subsystem and a control subsystem, all linked to a network.

The present invention is a system and corresponding components for providing functionality for firearm training.

Before explaining at least one embodiment of the invention in detail, it is to be understood that the invention is not necessarily limited in its application to the details of construction and the arrangement of the components and/or methods set forth in the following description and/or illustrated in the drawings and/or the examples. The invention is capable of other embodiments or of being practiced or carried out in various ways. Initially, throughout this document, references are made to directions such as, for example, front and rear, top and bottom, left and right, and the like. These directional references are exemplary only to illustrate the invention and embodiments thereof.

Referring now to the drawings, FIG. 1 shows an illustrative example environment in which embodiments of a system, generally designated 10, of the present disclosure may be performed over a network 150. The network 150 may be formed of one or more networks, including for example, the Internet, cellular networks, wide area, public, and local networks.

Figure 2:
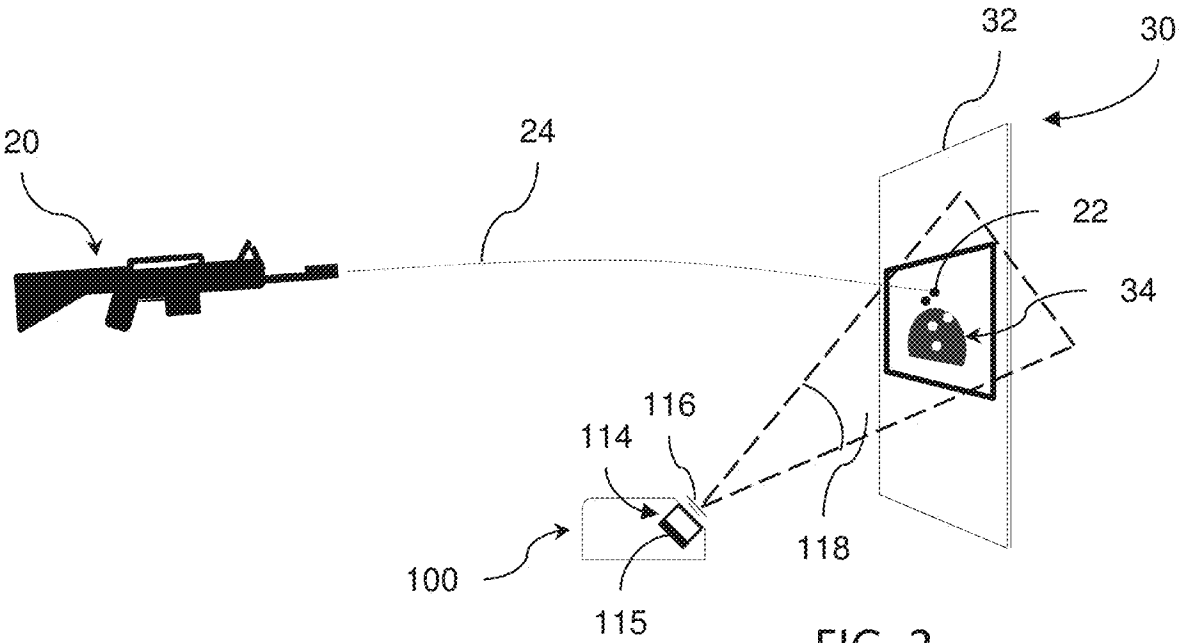
FIG. 2 is a schematic side view illustrating the end unit of the system deployed against a target array including a single target fired upon by a firearm, according to an embodiment of the invention.
Figure 3:
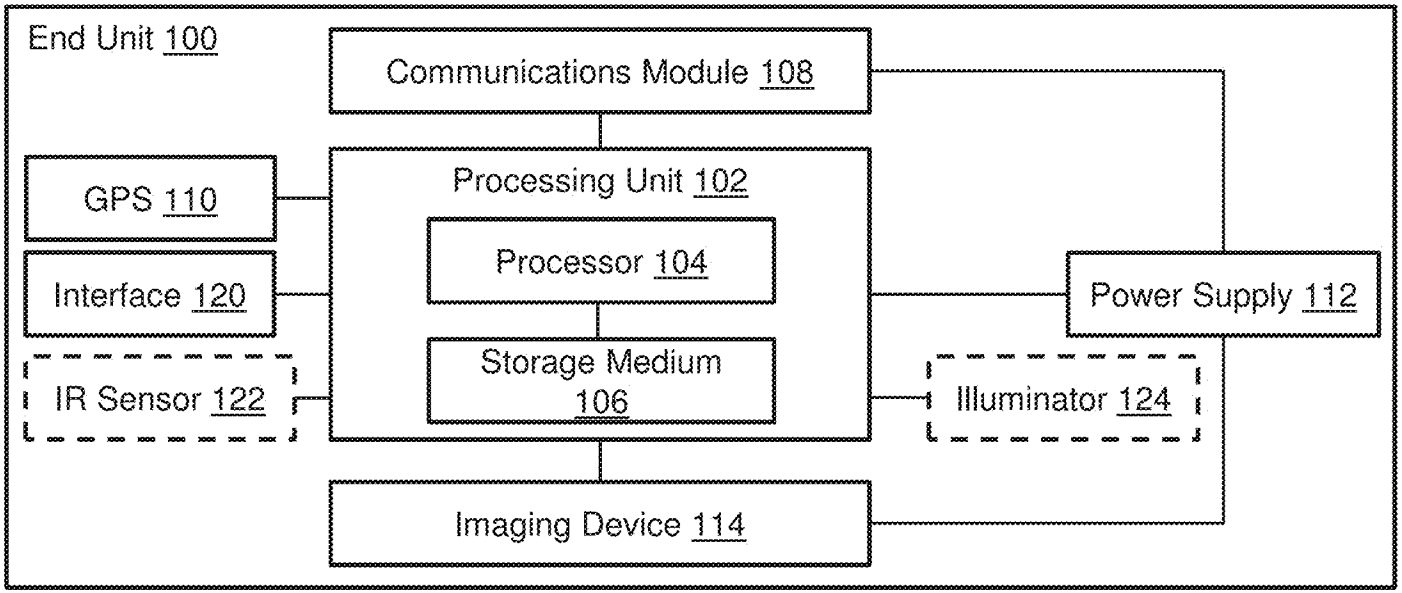
FIG. 3 is a block diagram of the components of the end unit, according to an embodiment of the invention.

With continued reference to FIG. 1, as well as FIGS. 2 and 3, the system 10 provides a functionality for training (i.e., target training or target practice) of a firearm 20. Generally speaking, the system 10 includes an end unit 100 which can be positioned proximate to a target array 30 that includes at least one target 34, a processing subsystem 132 for processing and analyzing data related to the target 34 and projectile strikes on the target 34, and a control subsystem 140 for operating the end unit 100 and the processing subsystem 132, and for receiving data from the end unit 100 and the processing subsystem 132.

Figure 7:
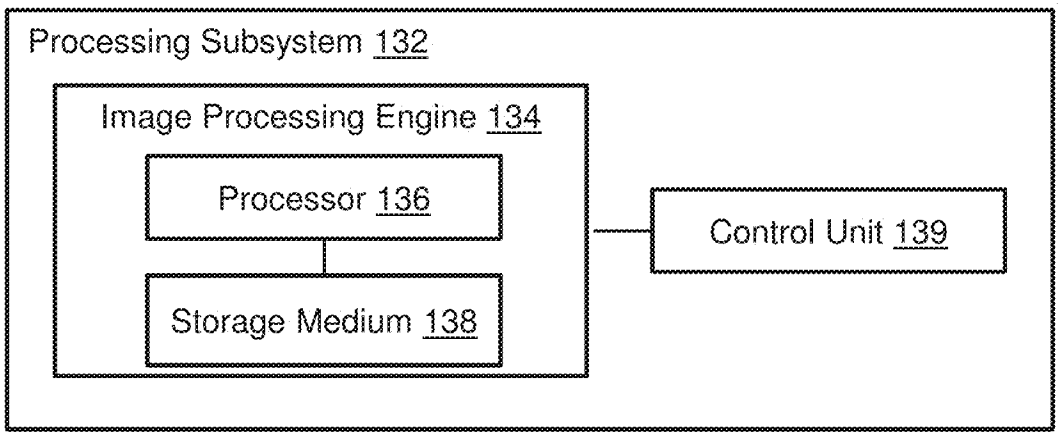
FIG. 7 is a block diagram of the components of the processing subsystem, according to an embodiment of the invention.

With reference to FIG. 7, the processing subsystem 132 includes an image processing engine 134 that includes a processor 136 coupled to a storage medium 138 such as a memory or the like. The image processing engine 134 is configured to implement image processing and computer vision algorithms to identify changes in a scene based on images of the scene captured over an interval of time. The processor 136 can be any number of computer processors, including, but not limited to, a microcontroller, a microprocessor, an ASIC, a DSP, and a state machine. Such processors include, or may be in communication with computer readable media, which stores program code or instruction sets that, when executed by the processor, cause the processor to perform actions. Types of computer readable media include, but are not limited to, electronic, optical, magnetic, or other storage or transmission devices capable of providing a processor with computer readable instructions. The processing subsystem 132 also includes a control unit 139 for providing control signals to the end unit 100 in order to actuate the end unit 100 to perform actions, as will be discussed in further detail below.

The system 10 may be configured to operate with different types of firearms. In the non-limiting embodiment illustrated in FIG. 2, the firearm 20 is implemented as a live ammunition firearm that shoots a live fire projectile 22 (i.e., a bullet) that follows a trajectory 24 path from the firearm 20 to the target 34. In other embodiments, as will be discussed in subsequent sections of the present disclosure, the firearm 20 may be implemented as a light pulse-based firearm which produces one or more pulses of coherent light (e.g., laser light). In such embodiments, the laser pulse itself acts as the projectile.

In addition, the system 10 may be configured to operate with different types of targets and target arrays. In the non-limiting embodiment illustrated in FIG. 2, the target 34 is implemented as a physical target that includes concentric rings 35*a-g*. In other embodiments, as will be discussed in subsequent sections of the present disclosure, the target 34 may be implemented as a virtual target projected onto a screen or background by an image projector connected to the end unit 100. Note that representation of the target 34 in FIG. 2 is exemplary only, and the system 10 is operable with other types of targets, including, but not limited to, human figure targets, calibration targets, three-dimensional targets, field targets, and the like.

As illustrated in FIG. 1, the processing subsystem 132 may be deployed as part of a server 130, which in certain embodiments may be implemented as a remote server, such as, for example, a cloud server or server system, that is linked to the network 150. The end unit 100, the processing subsystem 132, and the control subsystem 140 are all linked, either directly or indirectly, to the network 150, allowing network-based data transfer between the end unit 100, the processing subsystem 132, and the control subsystem 140.

The end unit 100 includes a processing unit 102 that includes at least one processor 104 coupled to a storage medium 106 such as a memory or the like. The processor 104 can be any number of computer processors, including, but not limited to, a microcontroller, a microprocessor, an ASIC, a DSP, and a state machine. Such processors include, or may be in communication with computer readable media, which stores program code or instruction sets that, when executed by the processor, cause the processor to perform actions. Types of computer readable media include, but are not limited to, electronic, optical, magnetic, or other storage or transmission devices capable of providing a processor with computer readable instructions.

The end unit 100 further includes a communications module 108, a GPS module 110, a power supply 112, an imaging device 114, and an interface 120 for connecting one or more peripheral devices to the end unit 100. All of the components of the end unit 100 are connected or linked to each other (electronically and/or data), either directly or indirectly, and are preferably retained within a single housing or casing with the exception of the imaging device 114 which may protrude from the housing or casing to allow for panning and tilting action, as will be discussed in further detail below. The communications module 108 is linked to the network 150, and in certain embodiments may be implemented as a SIM card or micro SIM, which provides data transfer functionality via cellular communication between the end unit 100 and the server 130 (and the processing subsystem 132) over the network 150.

The power supply 112 provides power to the major components of the end unit 100, including the processing unit 102, the communications module 108, and the imaging device 114, as well as any additional components (e.g., sensors and illumination components) and peripheral devices connected to the end unit 100 via the interface 120. In a non-limiting implementation, the power supply 112 is implemented as a battery, for example a rechargeable battery, deployed to retain and supply charge as direct current (DC) voltage. In certain non-limiting implementations, the output DC voltage supplied by the power supply 112 is approximately 5 volts DC, but may vary depending on the power requirements of the major components of the end unit 100.

In an alternative non-limiting implementation, the power supply 112 is implemented as a voltage converter that receives alternating current (AC) voltage from a mains voltage power supply, and converts the received AC voltage to DC voltage, for distribution to the other components of the end unit 100. An example of such a voltage converter is an AC to DC converter, which receives voltage from the mains voltage power supply via a cable and AC plug arrangement connected to the power supply 112. Note that the AC voltage range supplied by the mains voltage power supply may vary by region. For example, a mains voltage power supply in the United States typically supplies power in the range of 100-120 volts AC, while a mains voltage power supply in Europe typically supplies power in the range of 220-240 volts AC.

In operation, the processing subsystem 132 commands the imaging device 114 to capture images of the scene, and also commands the processing unit 102 to perform tasks. The control unit 139 may be implemented using a processor, such as, for example, a microcontroller. Alternatively, the processor 136 of the image processing engine 134 may be implemented to execute control functionality in addition to image processing functionality.

The end unit 100 may also include an illuminator 124 which provides capability to operate the end unit 100 in lighting environments, such as, for example, nigh time or evening settings in which the amount of natural light is reduced, thereby decreasing visibility of the target 34. The illuminator 124 may be implemented as a visible light source or as an infrared (IR) light source. In certain embodiments, the illuminator 124 is external from the housing of the end unit 100, and may be positioned to the rear of the target 34 in order to illuminate the target 34 from behind.

The imaging device 114 includes an image sensor 115 (i.e., detector) and an optical arrangement having at least one lens 116 which defines a field of view 118 of a scene to be imaged by the imaging device 114. The scene to be imaged includes the target 34, such that the imaging device 114 is operative to capture images of target 34 and projectile strikes on the target 34. The projectile strikes are detected by joint operation of the imaging device 114 and the processing subsystem 132, allowing the system 10 to detect strikes (i.e., projectile markings on the target 34) having a diameter in the range of 3-13 millimeters (mm).

The imaging device 114 may be implemented as a CMOS camera, and is preferably implemented as a camera having pan-tilt-zoom (PTZ) capabilities, allowing for adjustment of the azimuth and elevation angles of the imaging device 114, as well as the focal length of the lens 116. In certain non-limiting implementations, the maximum pan angle is at least 90° in each direction, providing azimuth coverage of at least 180°, and the maximum tilt angle is preferably at least 60°, providing elevation coverage of at least 120°. The lens 116 may include an assembly of multiple lens elements preferably having variable focal length so as to provide zoom-in and zoom-out functionality. Preferably the lens 116 provides zoom of at least 2×, and in certain non-limiting implementations provides zoom greater than 5×. As should be understood, the above range of angles and zoom capabilities are exemplary, and larger or smaller angular coverage ranges and zoom ranges are possible.

The control subsystem 140 is configured to actuate the processing subsystem 132 to commands the imaging device 114 to capture images, and to perform pan, tilt and/or zoom actions. The actuation commands issued by the control subsystem 140 are relayed to the processing unit 102, via the processing subsystem 132 over the network 150.

The system 10 is configured to selectively operate in two modalities of operation, namely a first modality and a second modality. The control subsystem 140 provides a control input, based on a user input command, to the end unit 100 and the processing subsystem 132 to operate the system 10 is the selected modality. In the first modality, referred to interchangeably as a first mode, calibration modality or calibration mode, the end unit 100 is calibrated in order to properly identify projectile strikes on the target 34. The calibration is based on the relative positioning between the end unit 100 and the target array 30. The firearm 20 should not be operated by a user of the system 10 during operation of the system 10 in calibration mode.

In the second modality, referred to interchangeably as a second mode, operational modality or operational mode, the processing subsystem 132 identifies projectile strikes on the target 34, based on the image processing techniques applied to the images captured by end unit 100, and provides statistical strike/miss data to the control subsystem 140. As should be understood, the firearm 20 is operated by the user of the system 10, in attempts to strike the target 34 one or more times. When the user is ready to conduct target practice during a shooting session using the system 10, the user actuates the system 10 to operate in the operational mode via a control input command to the control subsystem 140.

Figure 4:
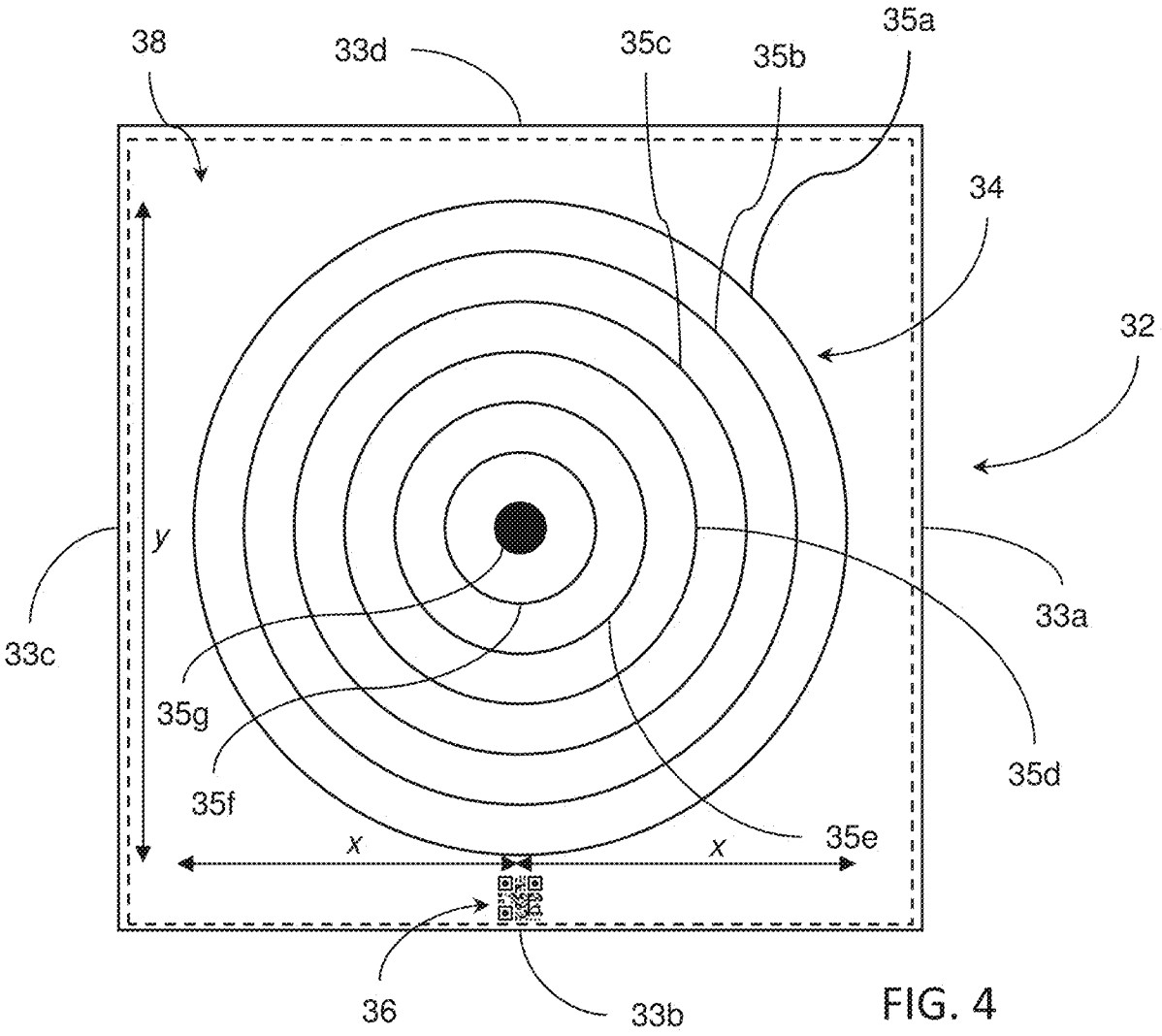
FIG. 4 is a schematic front view illustrating a target mounted to a target holder having a bar code deployed thereon, according to an embodiment of the invention.

In certain embodiments, the calibration of the system 10 is performed by utilizing a bar code deployed on or near the target 34. As illustrated in FIGS. 2 and 4, the target 34 is positioned on a target holder 32, having sides 33*a-d*. The target holder 32 may be implemented as a standing rack onto which the target 34 is be mounted. A bar code 36 is positioned on the target holder 32, near the target 34, preferably on the target plane and below the target 34 toward the bottom of the target holder 32. In certain embodiments, the bar code 36 is implemented as a two-dimensional bard code, more preferably a quick response code (QRC), which retains encoded information pertaining to the target 34 and the bar code 36. The encoded information pertaining to the bar code 36 includes the spatial positioning of the bar code 36, the size (i.e., the length and width) of the bar code 36, an identifier associated with the bar code 36, the horizontal (i.e., left and right) distance (x) between the edges of the bar code 36 and the furthest horizontal points on the periphery of the target 34 (e.g., the outer ring 35*a* in the example in FIG. 2), and the vertical distance (y) between the bar code 36 and the furthest vertical point on the periphery of the target 34. The encoded information pertaining to the target 34 includes size information of the target 34, which in the example of the target 34 in FIG. 2 may include the diameter of each of the rings of the target 34, the distance from the center of the target 34 to the sides of the target holder 32, and spatial positioning information of the target 34 relative to the bar code 36. As shown in the FIG. 4, the bar code 36 is preferably centered along the vertical axis of the target 34 with respect to the center ring 35*g*, thereby resulting in the left and right distances between the bar code 36 and the furthest points on the outer ring 35*a* being equal.

The encoded information pertaining to the target 34 and the bar code 36, specifically the horizontal distance x and the vertical distance y, serves as a basis for defining a coverage zone 38 of the target 34. The horizontal distance x may be up to approximately 3 meters (m), and the vertical distance y may be up to approximately 2.25 m. The coverage zone 38 defines the area or region of space for which the processing components of the system 10 (e.g., the processing subsystem 132) can identify projectile strikes on the target 34. In the example illustrated in FIG. 4, the coverage zone 38 of the target 34 is defined as a region having an area of approximately 2xy, and is demarcated by dashed lines.

Since the information encoded in the bar code 36 includes spatial positioning information of the bar code 36 and the target 34 (relative to the bar code 36), the spatial positioning of the bar code 36 and the target 34, in different reference frames, can be determined by either of the processing subsystem 132 or the processing unit 102. As such, the processor 104 preferably includes image processing capabilities, similar to the processor 136. Coordinate transformations may be used in order to determine the spatial positioning of the bar code 36 and the target 34 in the different reference frames.

Prior to operation of the system 10 in calibration or operational mode, the end unit 100 is first deployed proximate to the target array 30, such that the target 34 (or targets, as will be discussed in detail in subsequent sections of the document with respect to other embodiments of the present disclosure) is within the field of view 118 of the lens 116 of the imaging device 114. For effective performance of the system 10 in determining the projectile strikes on the target 34, the end unit 100 is preferably positioned relative to the target array 30 such that the line of sight distance between the imaging device 114 and the target 34 is in the range of 1-5 m, and preferably such that the line of sight distance between the imaging device 114 and the bar code 36 is in the range of 1.5-4 m. In practice, precautionary measures are taken in order to avoid damage to the end unit 100 by inadvertent projectile strikes. In one example, the end unit 100 may be positioned in a trench or ditch, such that the target holder 32 is in an elevated position relative to the end unit 100. In such an example, the end unit 100 may be positioned up to 50 centimeters (cm) below the target holder 32. In an alternative example, the end unit 100 may be covered or encased by a protective shell (not shown) constructed from a material having high strength-to-weight ratio, such as, for example, Kevlar®. The protective shell is preferably open or partially open on the side facing the target, to allow unobstructed imaging of objects in the field of view 118. In embodiments in which the end unit 100 operates with a single target 34, the end unit 100 may be mechanically attached to the target holder 32.

The following paragraphs describe the operation of the system 10 in calibration mode. The operation of the system 10 in calibration mode is described with reference to embodiments of the system 10 in which the target 34 is implemented as a physical target. However, as should be understood by one of ordinary skill in the art, operation of the system 10 in calibration mode for embodiments of the system in which the target 34 is implemented as a virtual target projected onto a screen or background by an image projector connected to the end unit 100 should be understood by analogy thereto.

In calibration mode, the end unit 100 is actuated by the control subsystem 140 to scan for bar codes that are in the field of view 118. In response to the scanning action, the end unit 100 recognizes bar codes in the field of view 118. The recognition of bar codes may be performed by capturing an image of the scene in the field of view 118, by the imaging device 114, and identifying bar codes in the captured image.

With continued reference to FIG. 4, if the bar code 36 is in the field of view 118, the end unit 100 recognizes the bar code 36 in response to the scanning action, and the encoded information stored in the bar code 36, including the defined coverage zone 38 of the target 34, is extracted by decoding the bar code 36. In the case of bar code recognition via image capture, the decoding of the bar code 36 may be performed by analysis of the captured image by the processing unit 102, analysis of the captured image by the processing subsystem 132, or by a combination of the processing unit 102 and the processing subsystem 132. Such analysis may include analysis of the pixels of the captured bar code image, and decoding the captured image according to common QRC standards, such as, for example, ISO/IEC 18004:2015.

As mentioned above, the field of view 118 is defined by the lens 116 of the imaging device 114. The imaging device 114 also includes a pointing direction, based on the azimuth and elevation angles, which can be adjusted by modifying the pan and tilt angles of the imaging device 114. The pointing direction of the imaging device 114 can be adjusted to position different regions or areas of a scene within the field of view 118. If the spatial position of the target 34 in the horizontal and vertical directions relative to the field of view 118 does not match the defined coverage zone 38, one or more imaging parameters of the imaging device 114 are adjusted until the bar code 36, and therefore the target 34, is spatially positioned properly within the coverage zone 38. In other words, if the defined coverage zone 38 of the target 34 is not initially within the field of view 118, panning and/or tilting actions are performed by the imaging device 114 based on calculated differences between the pointing angle of the imaging device 114 and the spatial positioning of the bar code 36.

Figure 5B:
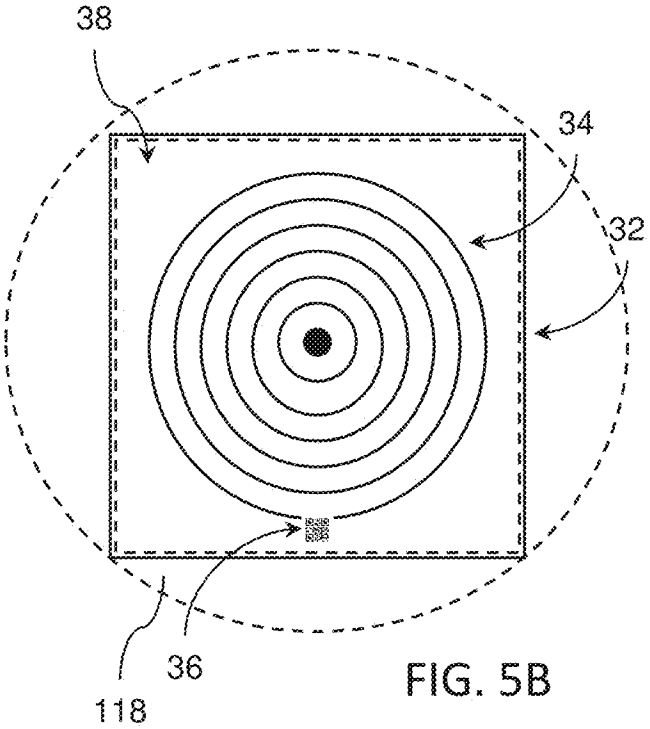
FIGS. 5A and 5B are schematic front views of a target positioned relative to the field of view of an imaging sensor of the end unit, according to an embodiment of the invention.
Figure 5A:
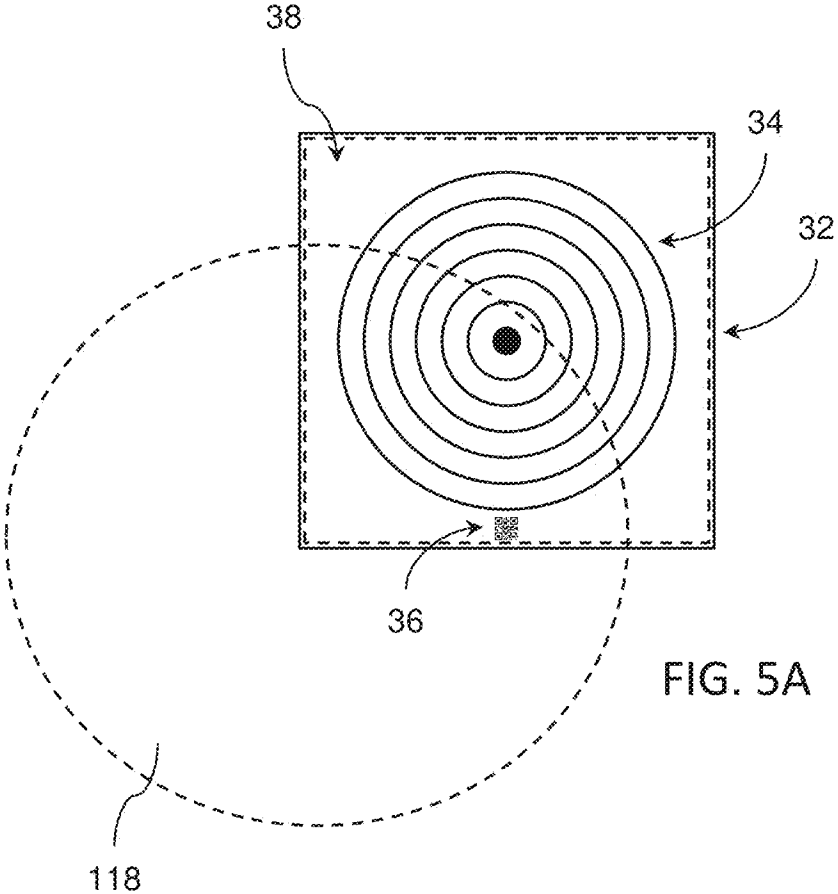

FIG. 5A illustrates the field of view 118 of the imaging device 114 when the imaging device 114 is initially positioned relative to the target holder 32. Based on the defined coverage zone 38, several imaging parameters, for example, the pan and tilt angles of the imaging device 114, are adjusted to align the field of view 118 with the defined coverage zone 38, as illustrated in FIG. 5B. The panning action of the imaging device 114 corresponds to horizontal movement relative to the target 34, while the tilting action of the imaging device 114 corresponds to vertical movement relative to the target 34. As should be understood, the panning and tilting actions are performed while keeping the base of the imaging device 114 at a fixed point in space.

In addition to aligning the field of view 118 with the coverage zone 38, the processing functionality of the system 10 (e.g., the processing unit 102 and/or the processing subsystem 132) can determine the distance to the target 34 from the end unit 100. As mentioned above, the encoded information pertaining to the bar code 36 includes the physical size of the bar code 36, which may be measured as a length and width (i.e., in the horizontal and vertical directions). The number of pixels dedicated to the portion of the captured image that includes the bar code 36 can be used as an indication of the distance between the end unit 100 and the bar code 36. For example, if the end unit 100 is positioned relatively close to the bar code 36, a relatively large number of pixels will be dedicated to the bar code portion 36 of the captured image. Similarly, if the end unit 100 is positioned relatively far from the bar code 36, a relatively small number of pixels will be dedicated to the bar code portion 36 of the captured image. As a result, a mapping between the pixel density of portions of the captured image and the distance to the object being imaged can be generated by the processing unit 102 and/or the processing subsystem 132, based on the bar code 36 size.

Based on the determined range from the end unit 100 to the bar code 36, the imaging device 114 may be actuated to adjust the zoom, to narrow or widen the size of the imaged scene, thereby excluding objects outside of the coverage zone 38 from being imaged, or including regions at the peripheral edges of the coverage zone 38 in the imaged scene. The imaging device 114 may also adjust the focus of the lens 116, to sharpen the captured images of the scene.

Note that the zoom adjustment, based on the above-mentioned determined distance, may successfully align the coverage zone 38 with desired regions of the scene to be imaged if the determined distance is within a preferred range, which as mentioned above is preferably 1.5-4 m. If the distance between the end unit 100 and the bar code 36 is determined to be outside of the preferred range, the system 10 may not successfully complete calibration, and in certain embodiments, a message is generated by the processing unit 102 or the processing subsystem 132, and transmitted to the control subsystem 140 via the network 150, indicating that calibration failed due to improper positioning of the end unit 100 relative to the target 34 (e.g., positioning too close to, or too far from, the target 34). The user of the system 10 may then physically reposition the end unit 100 relative to the target 34, and actuate the system 10 to operate in calibration mode.

According to certain embodiments, once the imaging parameters of the imaging device 114 are adjusted, in response to the recognition of the bar code 36, the imaging device 114 is actuated to capture an image of the coverage zone 38, and the captured image is stored in a memory, for example, in the storage medium 106 and/or the server 130. The stored captured image serves as a baseline image of the coverage zone 38, to be used to initially evaluate strikes on the target 34 during operational mode of the system 10. A message is then generated by the processing unit 102 or the processing subsystem 132, and transmitted to the control subsystem 140 via the network 150, indicating that calibration has been successful, and that the system 10 is ready to operate in operational mode.

By operating the system 10 in calibration mode, the imaging device 114 captures information descriptive of the field of view 118. The descriptive information includes all of the image information as well as all of the encoded information extracted from the bar code 36 and extrapolated from the encoded information, such as the defined coverage zone 38 of the target 34. The descriptive information is provided to the processing subsystem 132 in response to actuation commands received from the control subsystem 140. Note that in the embodiments described above, the functions executed by the system 10 when operating in calibration mode, in response to actuation by the control subsystem 140, are performed automatically by the system 10. As will be discussed in subsequent sections of the present disclosure, in other embodiments of the system 10, operation of the system 10 in calibration mode may also be performed manually by a user of the system 10, via specific actuation commands input to the control subsystem 140.

The following paragraphs describe the operation of the system 10 in operational mode. The operation of the system 10 in operational mode is described with reference to embodiments of the system 10 in which the target 34 is implemented as a physical target and the firearm 20 is implemented as a live ammunition firearm that shoots live ammunition. However, as should be understood by one of ordinary skill in the art, operation of the system 10 in operational mode for embodiments of the system in which the target 34 is implemented as a virtual target projected onto a screen or background by an image projector connected to the end unit 100 should be understood by analogy thereto.

In operational mode, the end unit 100 is actuated by the control subsystem 140 to capture a series of images of the coverage zone 38 at a predefined image capture rate (i.e., frame rate). Typically, the image capture rate is 25 frames per second (fps), but can be adjusted to higher or lower rates via user input commands to the control subsystem 140. Individual images in the series of images are compared with one or more other images in the series of images to identify changes between images, in order to determine strikes on the target 34 by the projectile 22. According to certain embodiments, the image comparison is performed by the processing subsystem 132, which requires the end unit 100 to transmit each captured image to the server 130, over the network 150, via the communications module 108. Each image may be compressed prior to transmission to reduce the required transmission bandwidth. As such, the image comparison processing performed by the processing subsystem 132 may include decompression of the images. In alternative embodiments, the image comparison may be performed by the processing unit 102. However, it may be advantageous to offload as much of the image processing functionality as possible to the processing subsystem 132 in order to reduce the complexity of the processing unit 102, thereby lessening the size, weight and power (SWAP) requirements of the end unit 100.

It is noted that the terms "series of images" and "sequence of images" may be used interchangeably throughout this document, and that these terms carry with them an inherent temporal significance such that temporal order is preserved. In other words, a first image in the series or sequence of images that appears prior to a second image in the series or sequence of images, implies that the first image was captured at a temporal instance prior to the second image.

Refer now to FIGS. 6A-6E, an example of five images 60*a-e* of the coverage zone 38 captured by the imaging device 114. The images captured by the imaging device 114 are used by the processing subsystem 132, in particular the image processing engine 134, in a process to detect one or more strikes on the target 34 by projectiles fired by the firearm 20. Generally speaking, the process relies on comparing a current image captured by the imaging device 114 with one or more previous images captured by the imaging device 114.

The first image 60*a* (FIG. 6A) is the baseline image of the coverage zone 38 captured by the imaging device 114 during the operation of the system 10 in calibration mode. In the example illustrated in FIG. 6A, the baseline image depicts the target 34 without any markings from previous projectile strikes (i.e., a clean target). However, the target may have one or more markings from previous projectile strikes.

The second image 60*b* (FIG. 6B) represents one of the images in the series of images captured by the imaging device 114 during operation of the system 10 in operational mode. As should be understood, each of the images in the series of images captured by the imaging device 114 during operation of the system 10 in operational mode are captured at temporal instances after the first image 60*a*. The first and second images 60*a-b* are transmitted to the processing subsystem 132 by the end unit 100, where the image processing engine 134 analyzes the two images to determine if a change occurred in the scene captured by the two images. In the example illustrated in FIG. 6B, the second image 60*b* is identical to the first image 60*a*, which implies that although the user of the system 10 may have begun operation of the firearm 20 (i.e., discharging of the projectile 22), the user has failed to strike the target 34 during the period of time after the first image 60*a* was captured. The image processing engine 134 determines that no change to the scene occurred, and therefore a strike on the target 34 by the projectile 22 is not detected. Accordingly, the second image 60*b* is updated as the baseline image of the coverage zone 38.

Figure 6C:
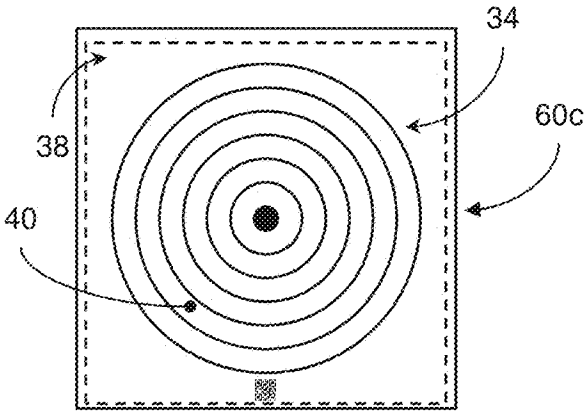
FIGS. 6A-6E are schematic front views of a series of images of a target captured by the imaging device, according to an embodiment of the invention.
Figure 6B:
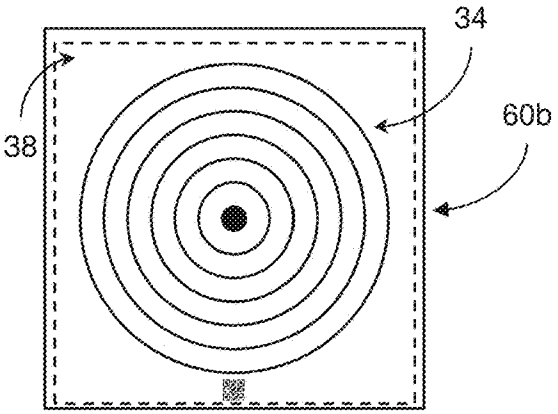
Figure 6A:
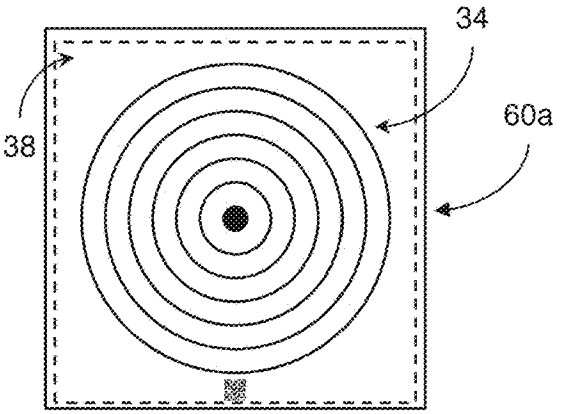

The third image 60*c* (FIG. 6C) represents a subsequent image in the series of images captured by the imaging device 114 during operation of the system 10 in operational mode. The third image 60*c* is captured at a temporal instance after the images 60*a-b*. The image processing engine 134 analyzes the second and third images 60*b-c* to determine if a change occurred in the scene captured by the two images. As illustrated in FIG. 6C, firing of the projectile 22 results in a strike on the target 34, illustrated in FIG. 6C as a marking 40 on the target 34. The image processing engine 134 determines that a change to the scene occurred, and therefore a strike on the target 34 by the projectile 22 is detected. Accordingly, the second image 60*b* is updated as the baseline image of the coverage zone 38.

Figure 6E:
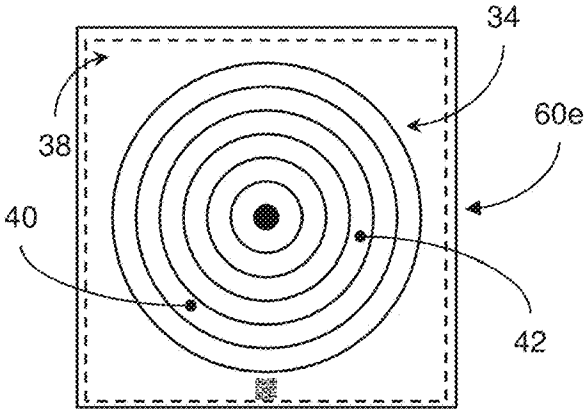
Figure 6D:
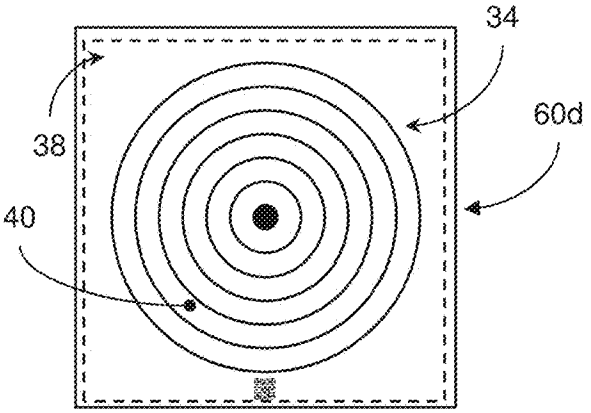

The fourth image 60*d* (FIG. 6D) represents a subsequent image in the series of images captured by the imaging device 114 during operation of the system 10 in operational mode. The fourth image 60*d* is captured at a temporal instance after the images 60*a-c*. The image processing engine 134 analyzes the third and fourth images 60*c-d* to determine if a change occurred in the scene captured by the two images. As illustrated in FIG. 6D, the fourth image 60*d* is identical to the third image 60*c*, which implies that the user has failed to strike the target 34 during the period of time after the third image 60*d* was captured. The image processing engine 134 determines that no change to the scene occurred, and therefore a strike on the target 34 by the projectile 22 is not detected. Accordingly, the fourth image 60*d* is updated as the baseline image of the coverage zone 38.

The fifth image 60*e* (FIG. 6E) represents a subsequent image in the series of images captured by the imaging device 114 during operation of the system 10 in operational mode. The fifth image 60*e* is captured at a temporal instance after the images 60*a-d*. The image processing engine 134 analyzes the fourth and fifth images 60*d-e* to determine if a change occurred in the scene captured by the two images. As illustrated in FIG. 6E, firing of the projectile 22 results in a second strike on the target 34, illustrated in FIG. 6E as a second marking 42 on the target 34. The image processing engine 134 determines that a change to the scene occurred, and therefore a strike on the target 34 by the projectile 22 is detected. Accordingly, the second image 60*b* is updated as the baseline image of the coverage zone 38.

As should be apparent, the process for detecting strikes on the target 34 may continue with the capture of additional images and the comparison of such images with previously captured images.

The term "identical" as used above with respect to FIGS. 6A-6E refers to images which are determined to be closely matched by the image processing engine 134, such that a change to the scene is not detected by the image processing engine 134. The term "identical" is not intended to limit the functionality of the image processing engine 134 to detecting changes to the scene only if the corresponding pixels between two images have the same value.

With respect to the above described process for detecting strikes on the target 34, the image processing engine 134 is preferably configured to execute one or more image comparison algorithms, which utilize one or more computer vision and/or image processing techniques. In one example, the image processing engine 134 may be configured to execute keypoint matching computer vision algorithms, which rely on picking points, referred to as "key points", in the image which contain more information than other points in the image. An example of keypoint matching is the scale-invariant feature transform (SIFT), which can detect and describe local features in images, described in U.S. Pat. No. 6,711,293.

In another example, the image processing engine 134 may be configured to execute histogram image processing algorithms, which bin the colors and textures of each captured image into histograms and compare the histograms to determine a level of matching between compared images. A threshold may be applied to the level of matching, such that levels of matching above a certain threshold provide an indication that the compared images are nearly identical, and that levels of matching below the threshold provide an indication that the compared images are demonstrably different.

In yet another example, the image processing engine 134 may be configured to execute keypoint decision tree computer vision algorithms, which relies on extracting points in the image which contain more information, similar to SIFT, and using a collection decision tree to classify the image. An example of keypoint decision tree computer vision algorithms is the features-from-accelerated-segment-test (FAST), the performance of which can be improved with machine learning, as described in "Machine Learning for High-Speed Corner Detection" by E. Rosten and T. Drummond, Cambridge University, 2006.

As should be understood, results of such image comparison techniques may not be perfectly accurate, resulting in false detections and/or missed detections, due to artifacts such as noise in the captured images, and due to computational complexity. However, the selected image comparison technique may be configured to operate within a certain tolerance value to reduce the number of false detections and missed detections.

Note that the image capture rate, nominally 25 fps, is typically faster than the maximum rate of fire of the firearm 20 when implemented as a non-automatic weapon. As such, the imaging device 114 most typically captures images more frequently than shots fired by the firearm 20. Accordingly, when the system 10 operates in operational mode, the imaging device 114 will typically capture several identical images of the coverage zone 38 which correspond to the same strike on the target 34. This phenomenon is exemplified in FIGS. 6B-6E, where no change in the scene is detected between the third and fourth images 60*c-d*.

Although embodiments of the system 10 as described thus far have pertained to an image processing engine 134 that compares a current image with a previous image to identify changes in the scene, thereby detecting strikes on the target 34, other embodiments are possible in which the image processing engine 134 is configured to compare the current image with more than one previous image, to reduce the probability of false detection and missed detection. Preferably, the previously captured images used for the comparison are consecutively captured images. For example, in a series of N images, if the current image is the $k^{th}$ image, the m previous images are the k-1, k-2, . . . , k-m images. In such embodiments, no decision on strike detection is made for the first m images in the series of images.

Each comparison of the current image to a group of previous images may be constructed from subsets of m pairwise comparisons, the output of each pairwise comparison being input to a majority logic decision. Alternatively, the image processing engine 134 may average the pixel values of the m previous images to generate an average image, which can be used to compare with the current image. The averaging may be implemented using standard arithmetic averaging or using weighted averaging.

During operational mode, the system 10 collects and aggregates strike and miss statistical data based on the strike detection performed by the processing subsystem 132. The strike statistical data includes accuracy data, which includes statistical data indicative of the proximity of the detected strikes to the rings 35*a-g* of the target 34. The evaluation of the proximity to the rings 35*a-g* of the target 34 is based on the coverage zone 38 and the spatial positioning information obtained during operation of the system 10 in calibration mode.

The statistical data collected by the processing subsystem 132 is made available to the control subsystem 140, via, for example, push request, in which the user of the system 10 actuates the control subsystem 140 to send a request to the server 130 to transmit the statistical results of target training activity to the control subsystem 140 over the network 150. The statistical results may be stored in a database (not shown) linked to the server 130, and may be stored for each target training session of the user of the end unit 100. As such, the user of the end unit 100 may request to receive statistical data from a current target training session and a previous target training session to gauge performance improvement. Such performance improvement may also be part of the aggregated data collected by the processing subsystem 132. For example, the processing subsystem 132 may compile a statistical history of a user of the end unit 100, summarizing the change in target accuracy over a period of time.

Although the embodiments of the system 10 as described thus far have pertained to an end unit 100, a processing subsystem 132 and a control subsystem 140 operating jointly to identify target strikes from a firearm implemented as a live ammunition firearm that shoots live ammunition, other embodiments are possible, as mentioned above, in which the firearm is implemented as a light pulse based firearm which produces one or more pulses of coherent light (e.g., laser light).

Figure 8:
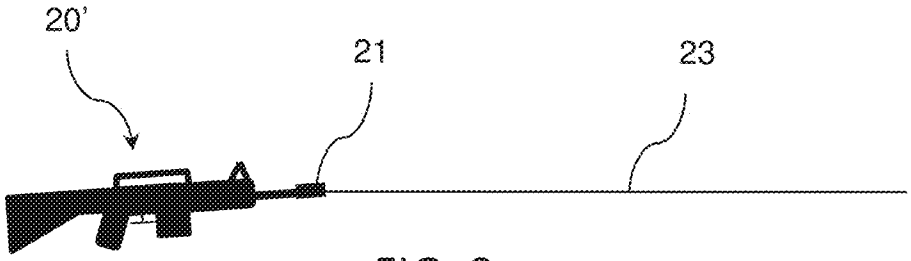
FIG. 8 is a schematic side view illustrating a firearm implemented as a laser-based firearm, according to an embodiment of the invention.

Refer now to FIG. 8, a firearm 20' implemented as a light pulse based firearm. The firearm 20' includes a light source 21 for producing one or more pulses of coherent light (e.g., laser light), which are output in the form of a beam 23. In such embodiments, the beam 23 acts as the projectile of the firearm 20'. According to certain embodiments, the light source 21 emits visible laser light at a pulse length of approximately 15 milliseconds (ms) and at a wavelength in the range of 635-655 nanometers (nm).

In other embodiments, the light source 21 emits IR light at a wavelength in the range of 780-810 nm. In such embodiments, in order to perform detection of strikes on the target by the beam 23, the end unit 100 is equipped with an IR image sensor 122 (referred to hereinafter as IR sensor 122) that is configured to detect and image the IR beam 23 that strikes the target 34. The processing components of the system 10 (i.e., the processing unit 102 and the processing subsystem 132) identify the position of the beam 23 strike on the target 34 based on the detection by the IR sensor 122 and the correlated position of the beam 23 in the images captured by the imaging device 114. The IR sensor may be implemented as an IR camera that is separate from the imaging device 114. Alternatively, the IR sensor 122 may be housed together with the image sensor 115 as part of the imaging device 114. In such a configuration, the image sensor 115 and the IR sensor 122 preferably share resources, such as, for example, the lens 116, to ensure that the sensors 115, 122 are exposed to the same field of view 118.

The process to detect one or more strikes on the target 34 is different in embodiments in which the firearm 20' is implemented as a light pulse-based firearm as compared to embodiments in which the firearm 20 is implemented a live ammunition firearm that shoots live ammunition. For example, each current image is compared with the last image in which no strike on the target 34 by the beam 23 was detected by the processing subsystem 132. If a strike on the target 34 by the beam 23 is detected by the processing subsystem 132, the processing subsystem 132 waits until an image is captured in which the beam 23 is not present in the image, essentially resetting the baseline image. This process avoids detecting the same laser pulse multiple times in consecutive frames, since the pulse length of the beam 23 is much faster than the image capture rate of the imaging device 114.

In order to execute the appropriate process to detect one or more strikes on the target 34 when the system 10 operates in operational mode, the bar code 36 preferably conveys to the system 10 the type of firearm 20, 20' to be used in operational mode. As such, according to certain embodiments, in addition to the bar code 36 retaining encoded information pertaining to the target 34 and the bar code 36, the bar code 36 also retains encoded information related to the type of firearm to be used in the training session. Accordingly, the user of the system 10 may be provided with different bar codes, some of which are encoded with information indicating that the training session uses a firearm that shoots live ammunition, and some of which are encoded with information indicating that the training session uses a firearm that emits laser pulses. The user may select which bar code is to be deployed on the target holder 32 prior to actuating the system 10 to operate in calibration mode. The bar code 36 deployed on the target holder 32 may be interchanged with another bar code, thereby allowing the user of the system 10 to deploy a bar code encoded with information specifying the type of firearm. In calibration mode, the type of firearm is extracted from the bar code, along with the above described positional information.

Although the embodiments of the system 10 as described thus far have pertained to an end unit 100 operating in tandem with processing components and a control system to identify target strikes, other embodiments are possible in which the end unit 100 additionally provides capabilities for interactive target training sessions. As mentioned above, and as illustrated in FIG. 3, the end unit 100 includes an interface 120 for connecting one or more peripheral devices to the end unit 100. The interface 120, although illustrated as a single interface, may represent one or more interfaces, each configured to connect a different peripheral device to the end unit 100.

Figure 9:
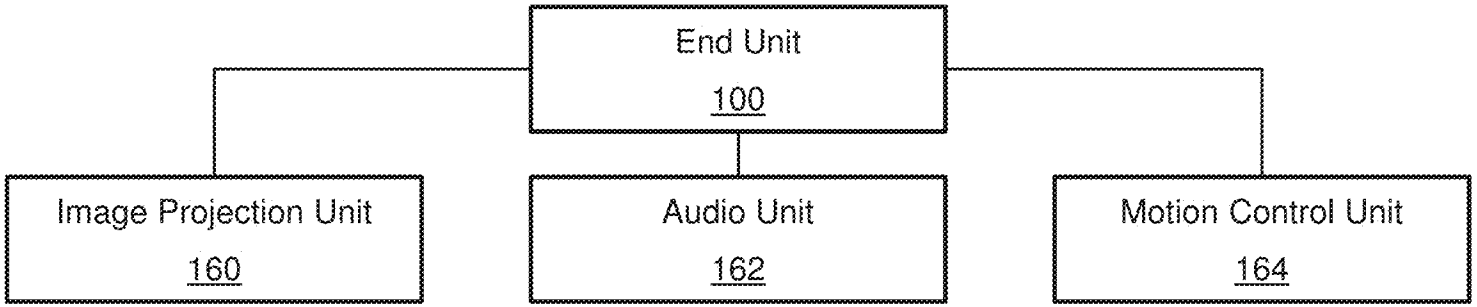
FIG. 9 is a block diagram of peripheral devices connected to the end unit, according to an embodiment of the invention.

Refer now to FIG. 9, a simplified block diagram of the end unit 100 connected with several peripheral devices, including an image projection unit 160 and an audio unit 162. The image projection unit 160 may be implemented as a standard image projection system which can project an image or a sequence of images against a background, for example a projection screen constructed of thermoelastic material. The image projection unit 160 can be used in embodiments in which the target 34 is be implemented as a virtual target. According to certain embodiments, the image projection unit 160 projects an image of the bar code 36 as well as an image of the target 34. In such embodiments, the system 10 operates in calibration and operational modes, similar to as described above.

The audio unit 162 may be implemented as a speaker system configured to play audio from an audio source embedded in the end unit 100. The processor 104, for example, may be configured to provide audio to the audio unit 162. The audio unit 162 and the image projection unit 160 are often used in tandem to provide an interactive training scenario which simulates real-life combat or combat-type situations. In such embodiments the bar code 36 also retains encoded information pertaining to the type of target 34 and the type of training session. As an example of such a training scenario, the image projection unit 160 may project a video image of an armed hostage taker holding a hostage. The audio unit 162 may provide audio synchronized with the video image projected by the image projection unit 160. In such a scenario, the hostage taker is treated by the system 10 as the target 34. As such, the region of the coverage zone 38 occupied by the target 34 changes dynamically as the video image of the hostage taker moves as the scenario progresses, and is used by the processing subsystem 132 to evaluate projectile strikes.

In response to a detected projectile strike or miss on the defined target (e.g., the hostage taker or other target object projected by the image projection unit 160), the system 10 may actuate the image projection unit 160 to change the projected image. For example, if the image projection unit 160 projects an image of a hostage taker holding a hostage, and the user fired projectile fails to strike the hostage taker, the image projection unit 160 may change the projected image to display the hostage taker attacking the hostage.

As should be apparent, the above description of the hostage scenario is exemplary only, and is intended to help illustrate the functionality of the system 10 when using the image projection unit 160 and other peripheral devices in training scenarios.

With continued reference to FIG. 9, the end unit 100 may also be connected to a motion control unit 164 for controlling the movement of the target 34. According to certain embodiments, the motion control unit 164 is physically attached to the target 34 thereby providing a mechanical coupling between the end unit 100 and the target 34. The motion control unit 164 may be implemented as a mechanical driving arrangement of motors and gyroscopes, allowing multi-axis translational and rotational movement of the target 34. The motion control unit 164 receives control signals from the control unit 139 via the processing unit 102 to activate the target 34 to perform physical actions, e.g., movement. The control unit 139 provides such control signals to the motion control unit 164 in response to events, for example, target strikes detected by the image processing engine 134, or direct input commands by the user of the system 10 to move the target 34.

Figure 10:
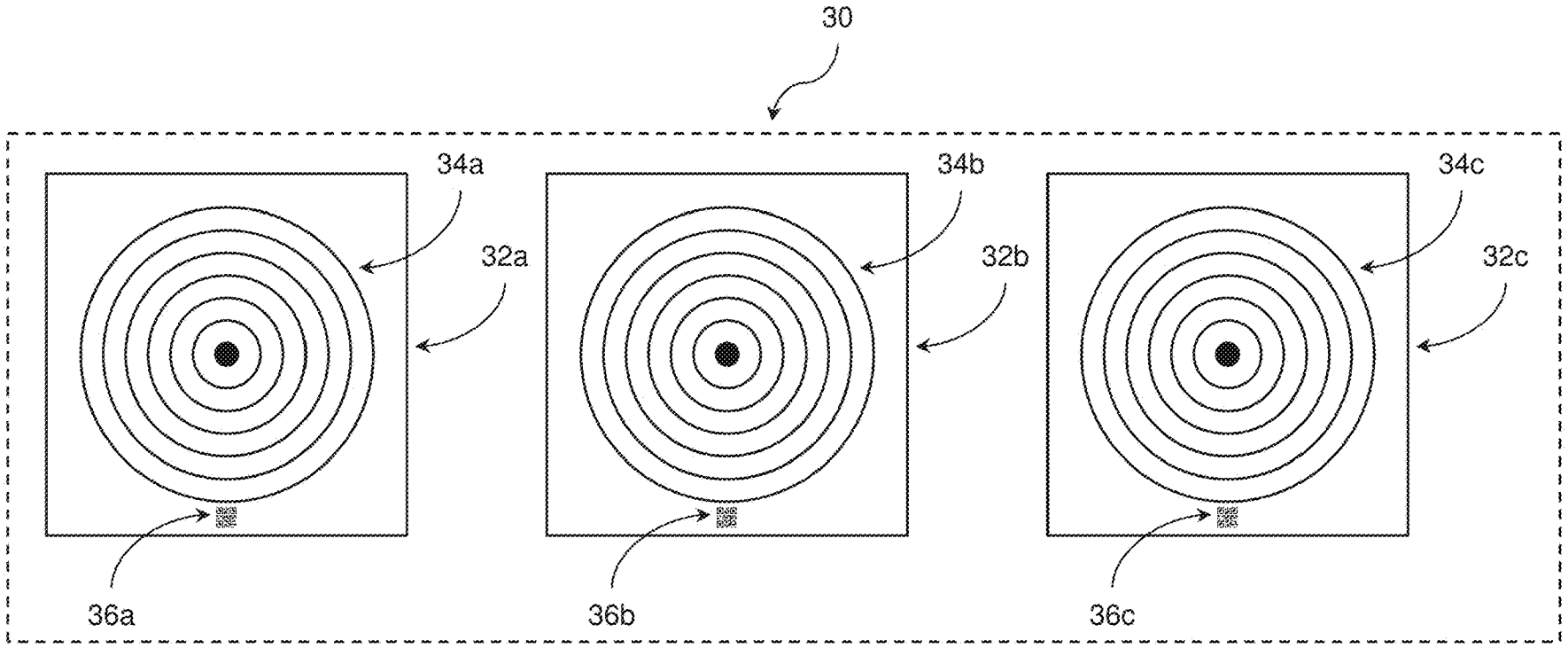
FIG. 10 is a schematic front view illustrating a target array including multiple targets, according to an embodiment of the invention.

Although the embodiments of the system 10 as described thus far have pertained to operation with a target array 30 that includes a single target, other embodiments are possible in which the target array 30 includes multiple targets. Refer now to FIG. 10, an exemplary illustration of a target array 30 that includes three targets, namely a first target 34*a*, a second target 34*b*, and a third target 34*c*. Each target is mounted to a respective target holder 32*a-c*, that has a respective bar code 36*a-c* positioned near the respective target 34*a-c*. The boundary area of the target array 30 is demarcated with a dotted line for clarity.

The use of multiple targets allows the user of the system 10 to selectively choose and alternate which of the individual targets to use for training. Although the targets 34*a-c* as illustrated in FIG. 10 appear identical and evenly spaced relative to each other, each target may be positioned at a different distance from the end unit 100, and at a different height relative to the end unit 100.

Note that the illustration of three targets in the target array 30 of FIG. 10 is for example purposes only, and should not be taken to limit the number of targets in the target array 30 to a particular value. In practice, a single target array 30 may include up to ten such targets.

Similar to as discussed above, prior to operation of the system 10 in calibration or operational mode, the end unit 100 is first deployed proximate to the target array 30, such that the targets 34*a-c* are within the field of view 118 of the lens 116 of the imaging device 114. As discussed above, in calibration mode, the end unit 100 is actuated by the control subsystem 140 to scan for bar codes that are in the field of view 118. In response to the scanning action, the end unit 100 recognizes the bar codes 36*a-c* in the field of view 118, via for example image capture by the imaging device 114 and processing by the processing unit 102 or the processing subsystem 132. In response to the recognition of the bar codes 36*a-c*, the control subsystem 140 receives from the end unit 100 an indication of the number of targets in the target array 30. For example, in the three-target deployment illustrated in FIG. 10, the control subsystem 140 receives an indication that the target array 30 includes three targets in response to the recognition of the bar codes 36*a-c*. Furthermore, each of the bar codes 36*a-c* is uniquely encoded to include an identifier associated with the respective bar codes 36*a-c*. This allows the control subsystem 140 to selectively choose which of the targets 36*a-c* to use when the system 10 operates in operational mode.

The operation of the system 10 in calibration mode in situations in which the target array 30 includes multiple targets, for example as illustrated in FIG. 10, is generally similar to the operation of the system 10 in calibration mode in situations in which the target array 30 includes a single target, for example as illustrated in FIGS. 2 and 4-5B. As discussed above, according to certain embodiments, the information descriptive of the field of view 118 that is captured by the imaging device 114 is provided to the processing subsystem 132 in response to actuation commands received from the control subsystem 140. The descriptive information includes all of the image information as well as all of the encoded information extracted from the bar codes 36*a-c* and extrapolated from the encoded information, which includes the defined coverage zone for each of the targets 34*a-c*. As noted above, the encoded information includes an identifier associated with each of the respective bar codes 36*a-c*, such that each of targets 34*a-c* is individually identifiable by the system 10. According to certain embodiments, the coverage zone for each of the targets 34*a-c* may be merged to form a single overall coverage zone. In such embodiments, a strike on any of the targets is detected by the system 10, along with identification of the individual target that was struck.

According to certain embodiments, when operating the system 10 in operational mode, the user of the system 10 is prompted, by the control subsystem 140, to select one of the targets 34*a-c* for which the target raining session will take place. The control subsystem 140 actuates the end unit 100 to capture a series of images, and the processing subsystem 132 analyzes regions of the images corresponding to coverage zone of the selected target. The analyzing performed by the processing subsystem 132 includes the image comparison, performed by the image processing engine 134, as described above.

Figure 11:
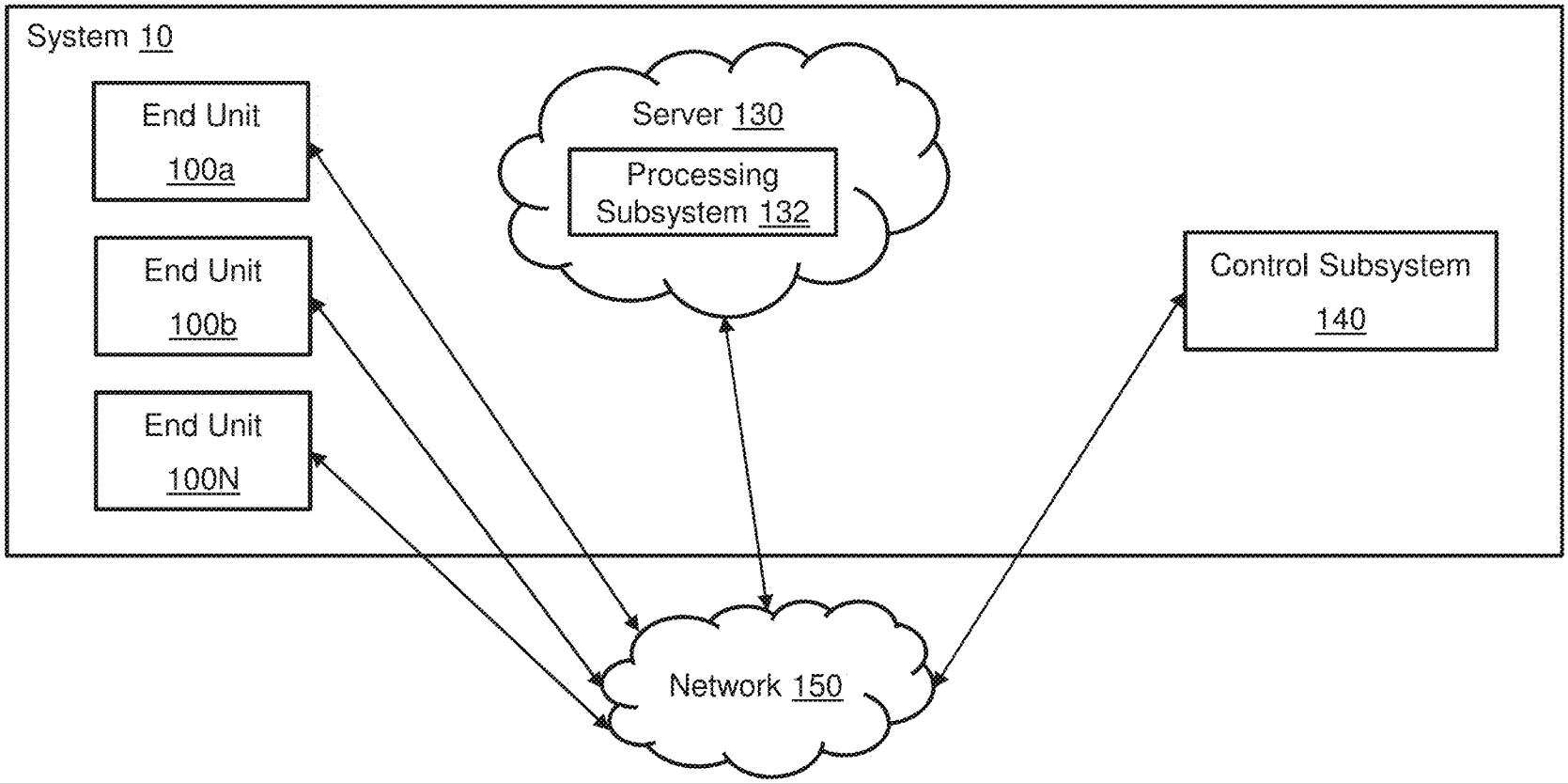
FIG. 11 is a diagram illustrating an environment in which a system according to an embodiment of the invention is deployed, similar to FIG. 1, the system including multiple end units, a processing subsystem and a control subsystem, all linked to a network.

Although the embodiments of the system 10 as described thus far have pertained to a control subsystem and a processing subsystem linked, via a network, to a single end unit (i.e., the end unit 100), other embodiments are possible in which the control subsystem 140 and the processing subsystem 132 are linked to multiple end units 100*a*-N, as illustrated in FIG. 11, with the structure and operation of each of the end units 100*a*-N being similar to that of the end unit 100. In this way, a single control subsystem can command and control an array of end units deployed in different geographic location.

The embodiments of the control subsystem 140 of the system 10 of the present disclosure have been described thus far in terms of the logical command and data flow between the control subsystem 140 and the end unit 100 and the processing subsystem 132. The control subsystem 140 may be advantageously implemented in ways which allow for mobility of the control subsystem 140 and effective accessibility of the data provided to the control subsystem 140. As such, according to certain embodiments, the control subsystem 140 is implemented as a management application 242 executable on a mobile communication device. The management application 242 may be implemented as a plurality of software instructions or computer readable program code executed on one or more processors of the mobile communication device. Examples of mobile communication devices include, but are not limited to, smartphones, tablets, laptop computers, and the like. Such devices typically included hardware and software which provide access to the network 150, which allow transfer of data to and from the network 150.

Figure 12:
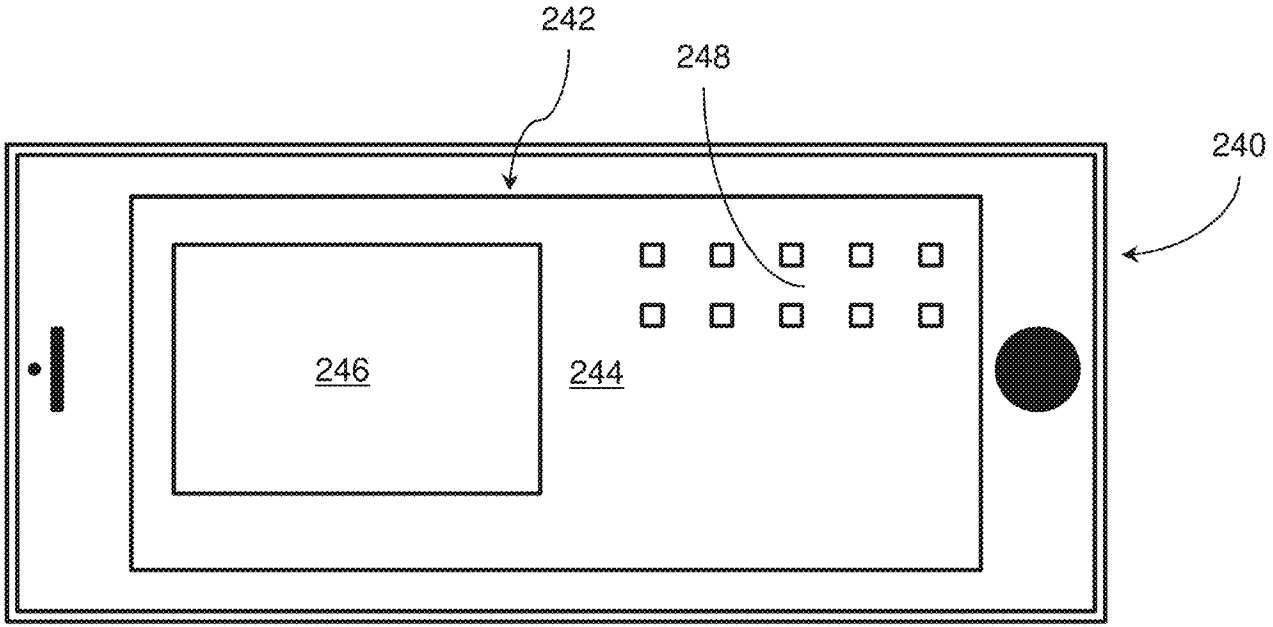
FIG. 12 is a schematic representation of the control subsystem implemented as a management application deployed on a mobile communication device showing the management application on a home screen.

Refer now to FIG. 12, a non-limiting illustration of the management application 242 executable on a mobile communication device 240. The management application 242 provides a command and control interface between the user and the components of the system 10. The management application 242, as illustrated in FIG. 12, includes a display area 244 with a home screen having multiple icons 248 for commanding the system 10 to take actions based on user touchscreen input. The display area 244 also includes a display region 246 for displaying information in response to commands input to the system 10 by the user via the management application 242. The management application 242 is preferably downloadable via an application server and executed by the operating system of the mobile communication device 240.

One of the icons 248 provides an option to pair the management application 242 with an end unit 100. The end unit 100 to be paired may be selectable based on location, and may require an authorization code to enable the pairing. The location of the end unit 100 is provided to the server 130 and the control subsystem 140 (i.e., the management application 242) via the GPS module 110. The pairing of the management application 242 and the end unit 100 is performed prior to operating the end unit in calibration or operational modes. As noted above, multiple end units may be paired with the control subsystem 140, and therefore with the management application 242. A map displaying the locations of the paired end units may be displayed in the display region 246. The locations may be provided by the GPS module 110 of each end unit 100, in response to a location request issued by the management application 242.

Upon initial download of the management application 242, no end units are typically paired with the management application 242. Therefore, one or more of the remaining icons 248 may be used to provide the user of the system 10 with information about the system 10 and system settings. For example, a video may be displayed in the display region 246 providing user instructions on how to pair the management application 242 with end units, how to operate the system 10 in calibration and operational modes, how to view statistical strike/miss data, how to generate and download interactive training scenarios, and other tasks.

Preferably, a subset of the icons 248 include numerical identifiers corresponding to individual end units to which the management application 242 is paired. Each of the icons 248 corresponding to an individual end unit 100 includes status information of the end unit 100. The status information may include, for example, power status and calibration status.

As mentioned above, the end unit 100 includes a power supply 112, which in certain non-limiting implementations may be implemented as a battery that retains and supplies charge. The icon 248 corresponding to the end unit 100 displays the charge level, for example, symbolically or numerically, of the power supply 112 of the end unit 100, when implemented as a battery.

The calibration status of the end unit 100 may be displayed symbolically or alphabetically, in order to convey to the user of the system 10 whether the end unit 100 requires operation in calibration mode. If the calibration status of the end unit 100 indicates that the end unit 100 requires calibration, the user may input a command to the management application 242, via touch selection, to calibrate the end unit 100. In response to the user input command, the system 10 operates in calibration mode, according to the processes described in detail above. Optionally, the user may manually calibrate the end unit 100 by manually entering the distance of the end unit 100 from the target 34, manually entering the dimensions of the desired coverage zone 38, and manually adjusting the imaging parameters of the imaging device 114 (e.g., zoom, focus, etc.). Such manual calibration steps may be initiated by the user inputting commands to the management application 242, via for example touch selection. Typically, the user of the system 10 is provided with both calibration options, and selectively chooses the calibration option based on an input touch command. The manual calibration option may also be provided to the user of the system 10 if the end unit 100 fails to properly read the bar code 36, due to system malfunction or other reasons, or if the bar code 36 is not deployed on the target holder 32. Note that the manual calibration option may be used to advantage in embodiments of the system 10 in which the target 34 is be implemented as a virtual target projected onto a screen or background by the image projection unit 160, as described above with reference to FIG. 9.

As mentioned above, each end unit 100 that is paired with the management application 242 has an icon 248, preferably a numerical icon, displayed in display area 244. According to certain embodiments, selection of an icon 248 that corresponds to an end unit 100 changes the display of the management application 242 from the home screen to an end unit details screen associated with that end unit 100.

Figure 13:
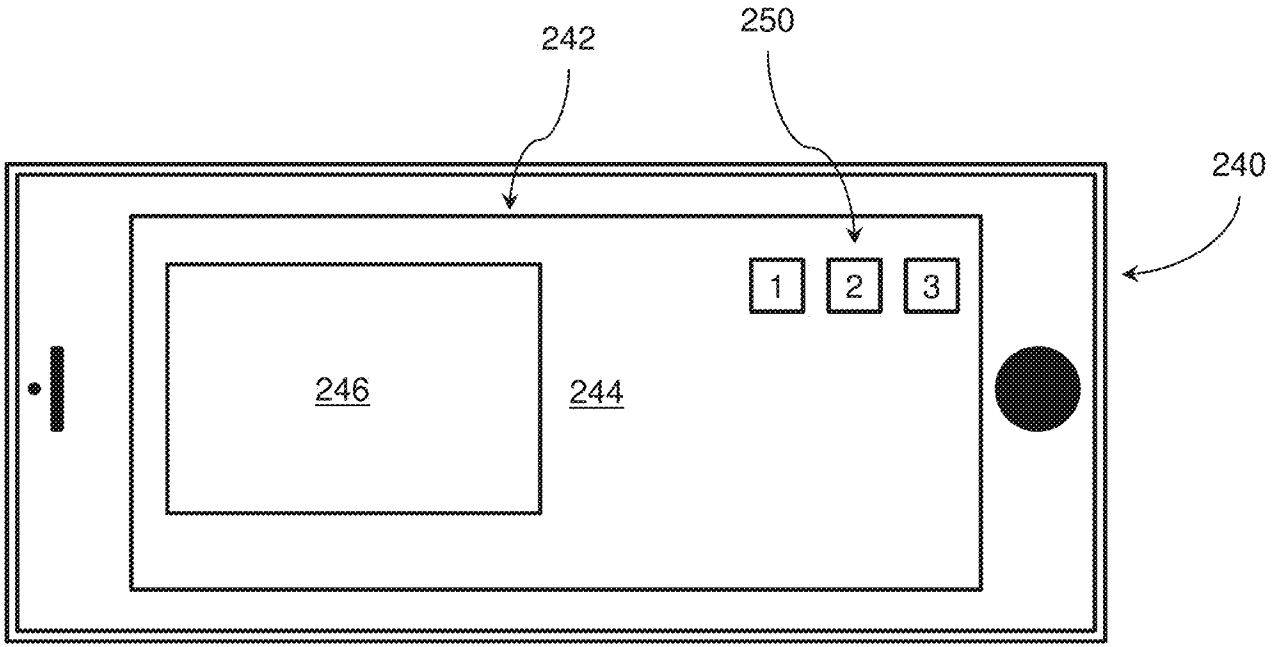
FIG. 13 is a schematic representation of the control subsystem implemented as a management application deployed on a mobile communication device showing the management application on a details screen.

Referring to FIG. 13, a non-limiting illustration of the details screen. The details screen preferably includes additional icons 250 corresponding to the targets of the target array 30 proximate to which the end unit 100 is deployed. As mentioned above, each of the targets 34 of the target array 30 includes an assigned identifier encoded in respective the bar code 36. The assigned identifier is preferably a numerical identifier, and as such, the icons corresponding to the targets 34 are represented by the numbers assigned to the targets 34. Referring again to example illustrated in FIG. 10, the first target 34*a* may be assigned the identifier '1', the second target 34*b* may be assigned the identifier '2', and the third target 34*c* may be assigned the identifier '3'. Accordingly, the details screen displays three icons 250 labeled as '1', '2', and '3'. The details screen may also display an image, as captured by the imaging device 114, of the target 34 in the display region 246.

According to certain embodiments, selection of one of the icons 250 displays target strike data and statistical data, that may be current and/or historical data, indicative of the proximity of the detected strikes on the selected target 34. The data may be presented in various formats, such as, for example, tabular formats, and may displayed in the display region 246 or other regions of the display area 244. In a non-limiting implementation, the target strike data is presented visually as an image of the target 34 and all of the points on the target 34 for which the system 10 detected a strike from the projectile 22. In this way, the user of system 10 is able to view a visual summary of a target shooting session.

Note that the functionality of the management application 242 may also be provided to the user of the system 10 through a web site, which may be hosted by a web server (not shown) linked to the server 130 over the network 150.

As discussed throughout the present disclosure, the imaging device 114 is operative to capture images of the scene, and more specifically images of the target 34, when the system 10 operates in both calibration and operational modes. In the previously described embodiments, the images captured by the imaging device 114 are visible light images. One drawback of capturing visible light images during operation in operational mode is that detection of projectile strikes on the target 34 by the relevant processing systems—based on the images of the target 34 captured by the imaging device 114—may be limited due in part to lighting and shadow effects on the target. This may become particularly problematic when the target is a virtual target that is part of a virtual training scenario, for example a scenario projected onto a projection screen by the image projection unit 160, where the processing system identifies projectile strikes by detecting holes in the projection screen created by the projectiles, but where such holes may be in dark or shaded regions of the projection screen which makes the holes difficult to discern from the dark or shaded regions.

One solution which overcomes such drawbacks is the use of processors that implement more advanced processing technologies that can more easily differentiate between holes and dark or shaded regions on the projection screen. However, such solutions require more complex processing architectures, which can become prohibitively expensive.

Another possible solution, discussed in previously described embodiments, is the deployment of a dedicated IR sensor 122 which detects and images IR light. IR imaging of a target makes the projectile strikes on the target (such as holes in the projection screen) more easily distinguishable from dark or shaded regions of the target or projection screen. However, utilizing an IR image sensor for image capture in calibration mode of the system 10 is not ideal as IR images may not provide high enough image resolution in order to accurately extract target spatial information and coverage zone. Therefore, such a dedicated IR image sensor should be used in combination with the image sensor 115, where the image sensor 115 is used in calibration mode and the IR image sensor is used in operational mode. However, this solution requires two separate image sensors which is increases cost. Furthermore, the use of one image sensor in calibration mode and another image sensor in operational mode requires that the processing components of the system 10 that control the image sensors (e.g., the processing unit 102 and/or the processing subsystem 132) actively switch the image sensors on and off during operation of the system 10, which increases processing and control complexity. However, it is noted that the present disclosure does not preclude embodiments which utilize the image sensor 115 and the IR sensor 122 in tandem.

In order to provide a cost-effective and low-complexity solution that yields accurate projectile strike detection performance, the present embodiments utilize the image sensor 115 of the imaging device 114 to capture visible light images of the target 34 during calibration mode, and then utilize the same image sensor 115 of the same imaging device 114 to capture infrared (IR) images of the target 34 during operational mode. The key is to employ an IR positioning mechanism, operatively coupled to the end unit 100, that can position an IR filter in and out of the optical path from the scene (i.e., the target 34) to the image sensor 115 in accordance with the mode of the operation of the system 10. It is noted that in such embodiments, the image sensor 115 is sensitive to all radiation in wavelengths between approximately 350 nm and approximately 1000 nm, i.e., is sensitive to radiation in the visible light regions (350 nm-700 nm) and IR regions (700 nm-1000 nm) of the electromagnetic spectrum. Parenthetically, most commercial off the shelf (COTS) cameras include image sensors that are sensitive to radiation in the IR and visible light regions of the electromagnetic spectrum. However, such cameras typically contain dichroic filters, in the form of hot mirrors, which block IR radiation from reaching the image sensor by reflecting incoming IR light. Therefore, when utilizing a COTS camera as the imaging device 114, the IR blocking dichroic filter should be removed or disabled in order to provide the imaging device 114 with the capability of capturing full spectral images.

Figure 14:
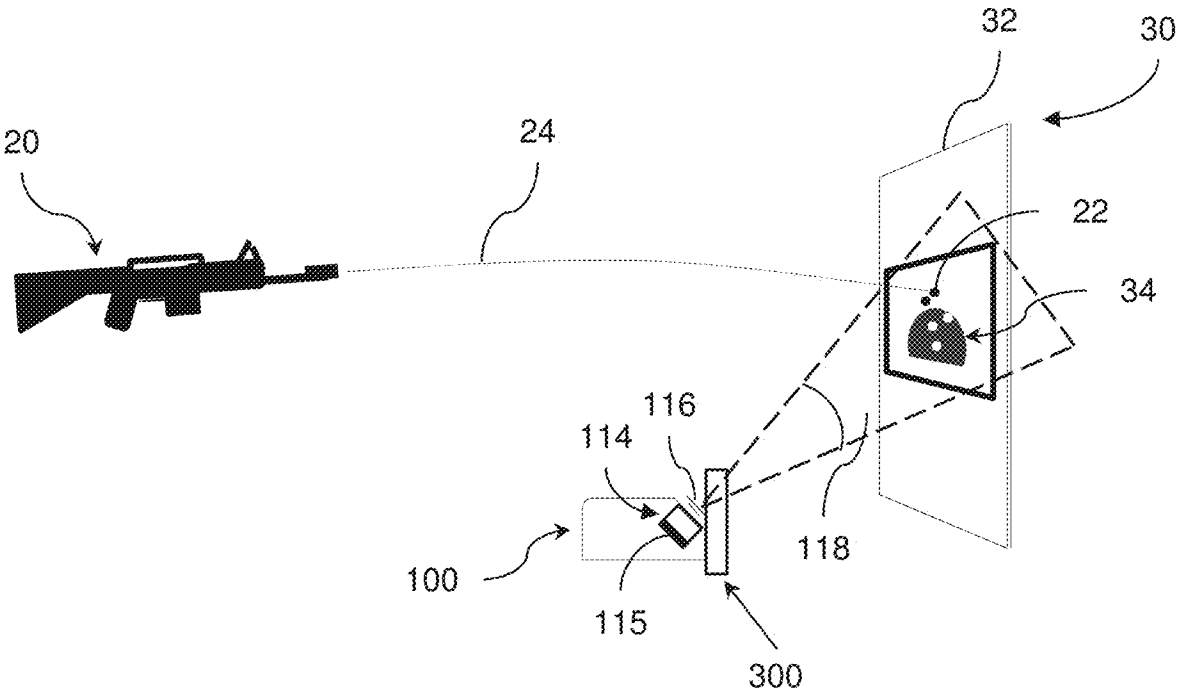
FIG. 14 is a schematic side view similar to FIG. 2, and further illustrating an infrared filter (IR) assembly coupled to the end unit, according to an embodiment of the present invention.

Refer now to FIG. 14, a schematic side view representation of the end unit 100 of the system 10 deployed against the target 34 according to the present embodiments in which the system 10 further includes an IR filter assembly 300 that is deployed to selectively position an IR filter in and out of a portion of the optical path from the scene (to be imaged by the imaging device 114) to the image sensor 115. As will become apparent from the following description, one of the advantages of the present embodiments is that the IR filter assembly 300 can be deployed as an add-on component to an existing imaging device whereby the portion of the optical path is between the scene and the lens of the imaging device, and does not require a more complex imaging device in which a switchable IR filter is deployed internal to the imaging device so as to be positionable in and out of the portion of the optical path that is between the imaging lens and the image sensor. However, it is noted that the present disclosure does not preclude embodiments of such aforementioned more complex solutions.

Within the context of the present disclosure, the term "IR filter" generally refers to a filter that passes IR light and blocks non-IR light. In other words, IR filters, within the context of this document, pass radiation at wavelengths in the IR region of the electromagnetic spectrum (i.e., in the range between approximately 700 nm and 1000 nm) and block radiation at wavelengths outside of the IR region of the electromagnetic spectrum (i.e., less than 700 nm and greater than 1000 nm).

With continued reference to FIG. 14, refer now to FIGS. 15A-16B, various schematic views of the IR filter assembly 300 deployed relative to the imaging device 114. The IR filter assembly 300 includes an IR filter 302 and an IR filter positioning mechanism 310 (referred to hereinafter as positioning mechanism 310) that is operative to selectively move/position the IR filter 302 in and out of a portion of the optical path (generally designated 350 in FIGS. 16A and 16B) from the scene to the imaging device 114, and more particularly from the scene to the image sensor 115. The optical path 350 is defined by the optical arrangement (lens 116) of the imaging device 114. Generally speaking, the scene includes the target 34 when the end unit 100 is properly deployed and positioned adjacent to the target 34 such that the target 34 is in the field of view 118.

The optical path 350 from the scene to the image sensor 114 is generally defined herein as the region of space through which light from the scene can traverse directly to and through the imaging device 114 so as to be imaged by the lens 116 onto the image sensor 115. The optical path 350 overlaps entirely with the field of view 118 defined by the lens 116, and includes two optical portions. A first optical path portion (generally designated 352) between the scene and the lens 116, and a second optical path portion (generally designated 354) between the lens 116 and the image sensor 115. In the preferred but non-limiting embodiments illustrated in FIGS. 14-16B, the IR filter 302 is positionable a short distance in front of the lens 116, and between the lens 116 and the scene, i.e., the portion of the optical path 350 is the optical path portion 352 between the scene and the lens 116.

When the IR filter 302 is positioned in the optical path 350, all of the light from the scene within the field of view 118 passes through the IR filter 302, such that the visible light within the field of view 118 is blocked by the IR filter 302 and only the IR light within the field of view 118 reaches the image sensor 115. Conversely, when the IR filter 302 is positioned out of the optical path 350, none of the light from the scene passes through the IR filter 302 such that all of the light (both visible and IR) from the scene within the field of view 118 reaches the image sensor 115.

The positioning mechanism 310 includes an electromechanical actuator 312 in mechanical driving relationship with the IR filter 302. Many actuator configurations are contemplated herein, including, but not limited to, rotary actuators and linear actuators. In the non-limiting implementation illustrated in the drawings, the actuator 312 is implemented as a rotary actuator, such as, for example, the MG996R servomotor available from Tower Pro of Taiwan, that generates circular to linear motion via a generally planar rotating disk 314 that is mechanically linked to the actuator 312. A rod 316 extending normal to the plane of the disk 314 is attached at a point on the disk 314 that is preferably at a radial distance from a central spindle 315 of at least 50% of the radius of the disk 314, and more preferably at a radial distance from the central spindle 315 of approximately 75% of the radius of the disk 314.

The IR filter 302 is attached to the actuator 312 via an aperture 308 located at a first end 304 of the IR filter 302. The aperture 308 and the rod 316 are correspondingly configured, such that the rod 316 fits through the aperture 308. The IR filter 302 is secured to the rod 316 via a fastening arrangement, such a mechanical fastener. For example, the rod 316 may be implemented as a bolt having a shank portion and a threaded portion. In such an implementation, the bolt (rod 316) is passed through the aperture 308 of the IR filter 302, and a nut having complementary threading to the bolt is secured to the bolt to attach the filter 302 to the actuator 312.

In operation, as the actuator 312 rotates the disk 314 about the central spindle 315, the rotational movement of the disk 314 drives the IR filter 302 and induces linear movement of the IR filter 302, thereby moving a second end 306 of the IR filter 302 into and out of the optical path 350 so as to block and unblock the lens 116.

According to certain embodiments, the IR filter assembly 300 includes a guiding arrangement 318 attached to the housing 117 of the imaging device 114 for guiding the IR filter 302 along a guide path 324. The guiding arrangement 318 delimits the movement of the IR filter 302 during movement in and out of the optical path 350. The guiding arrangement 318 preferably includes a pair of parallel guide rails that define the guide path 324. In the drawings, the parallel guide rails are depicted as a first guide rail 320 and a second guide rail 322, that are positioned generally tangent to the lens 116 at diametrically opposed peripheral portions of the lens 116. In the preferred but non-limiting embodiments illustrated in FIGS. 14-16B, the guiding arrangement 318 and the guide path 324 are positioned in front of the lens 116.

Figure 16A:
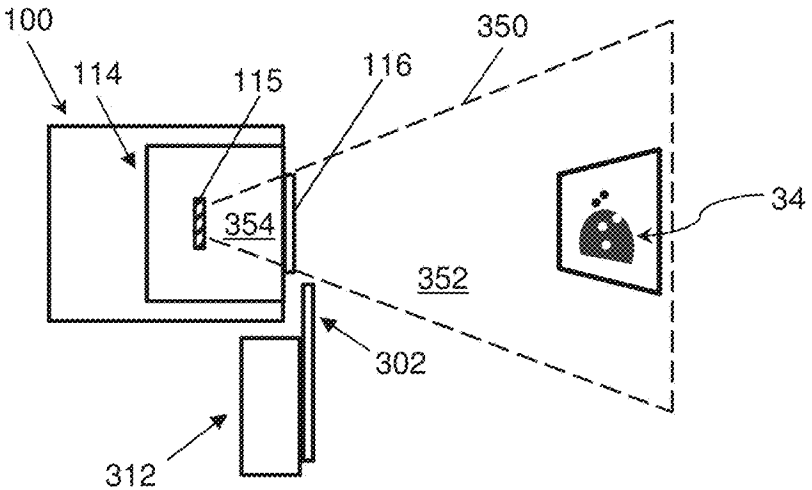
FIG. 16A is a schematic side view corresponding to FIG. 15A.
Figure 15A:
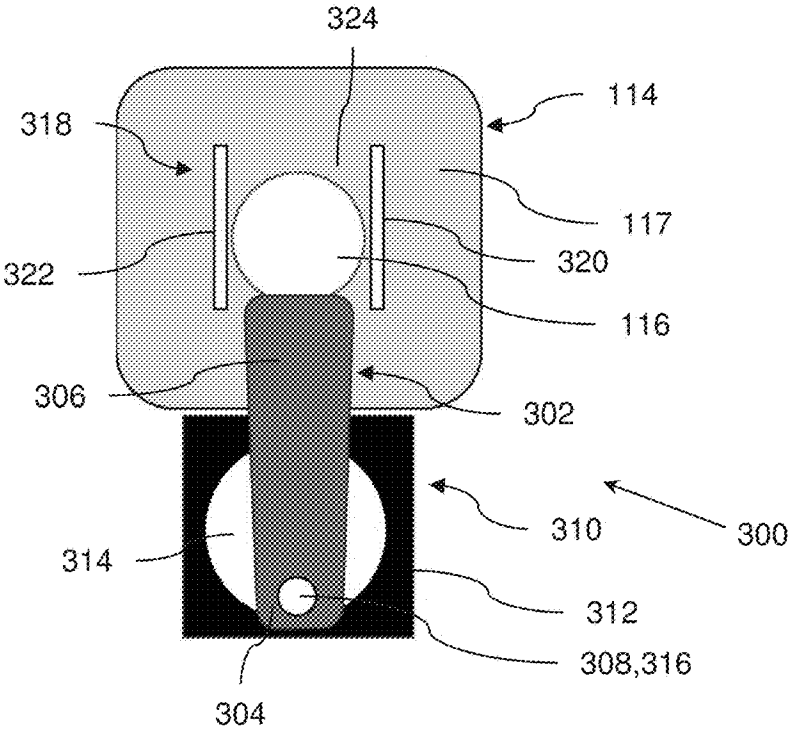
FIG. 15A is a schematic front view illustrating an IR positioning mechanism and an IR filter of the IR filtering assembly, with the IR positioning mechanism assuming a first state such that the IR filter is positioned out of an optical path from a scene to an image sensor of the end unit.

With particular reference to FIGS. 15A and 16A, there are shown schematic front and side views, respectively, of the IR filter assembly 300 with the positioning mechanism 310 assuming a first state in which the IR filter 302 is positioned out of the optical path 350. As will be discussed in subsequent sections of the present disclosure, the positioning mechanism 310 assumes the first state when the system 10 operates in calibration mode.

Figure 16B:
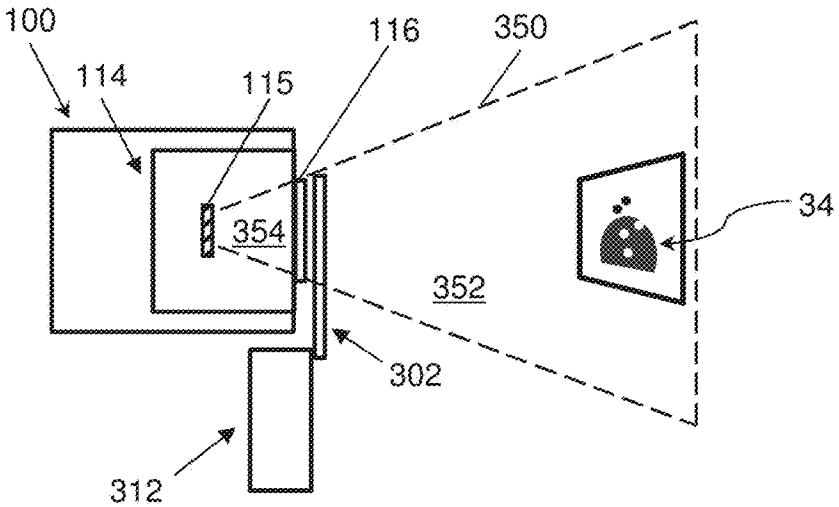
FIG. 16B is a schematic side view corresponding to FIG. 15B.
Figure 15B:
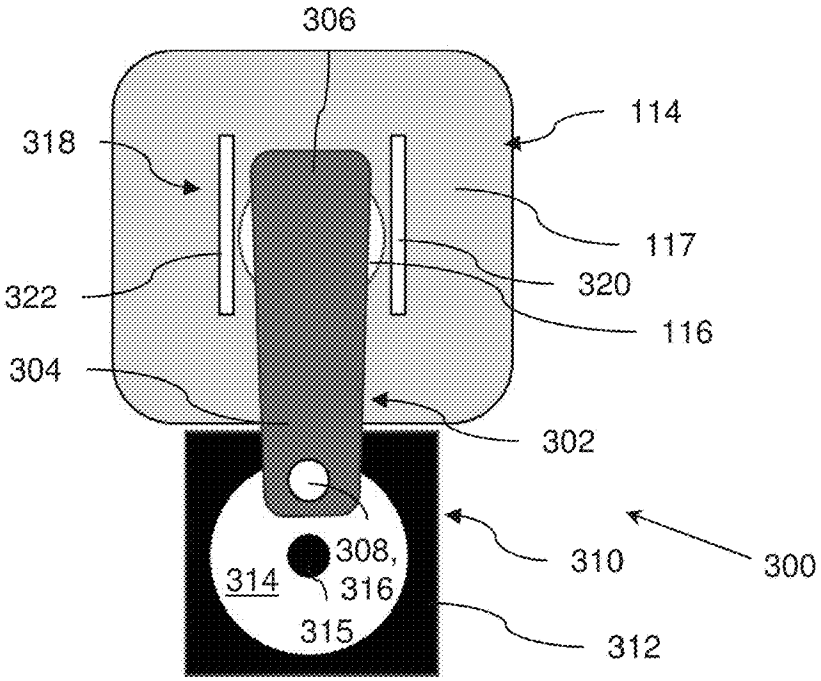
FIG. 15B is a schematic front view illustrating the IR positioning mechanism and the IR filter, with the IR positioning mechanism assuming a second state such that the IR filter is positioned in the optical path.

Looking now at FIGS. 15B and 16B, there are shown schematic front and side views, respectively, similar to FIGS. 15A and 16A, but with the positioning mechanism 310 assuming a second state in which the IR filter 302 is positioned in the optical path 350 so as to block the lens 116. As will be discussed in subsequent sections of the present disclosure, the positioning mechanism 310 assumes the second state when the system 10 operates in operational mode.

Figure 15D:
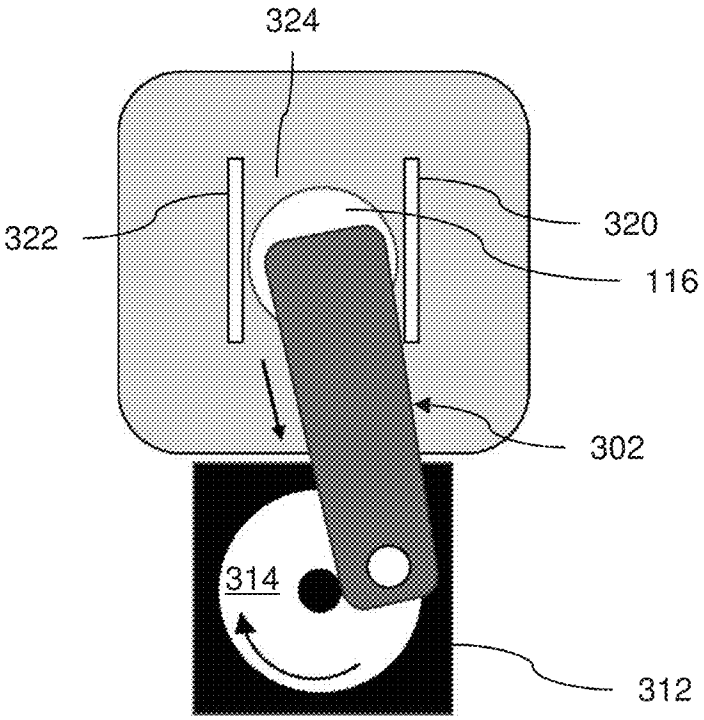
FIG. 15D is a schematic front view illustrating the IR positioning mechanism and the IR filter, with the IR positioning mechanism assuming another intermediate state such that the IR filter is in transition from in the optical path to out of the optical path.
Figure 15C:
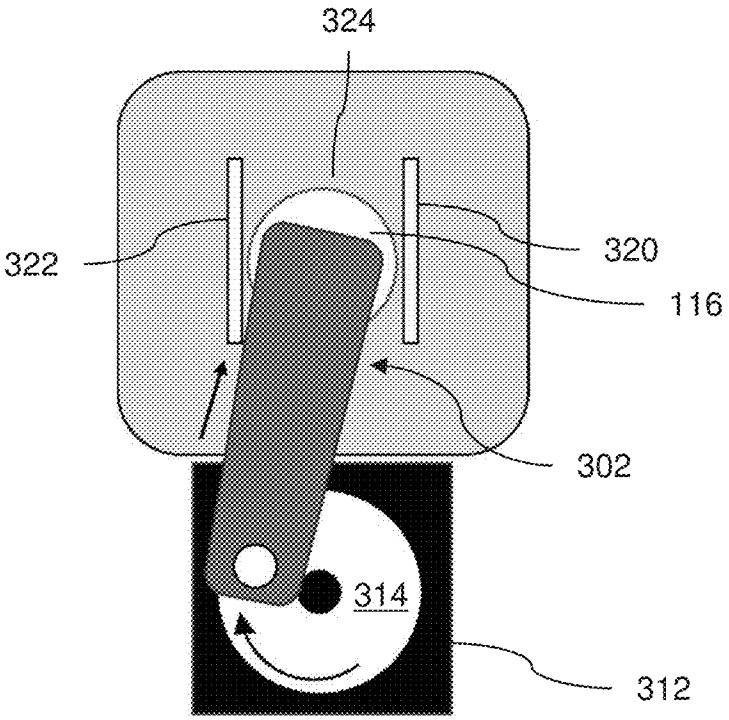
FIG. 15C is a schematic front view illustrating the IR positioning mechanism and the IR filter, with the IR positioning mechanism assuming an intermediate state such that the IR filter is in transition from out of the optical path to into the optical path.

FIGS. 15C and 15D show schematic front views illustrating the positioning mechanism 310 assuming intermediate states between the first and second states. Particularly, FIG. 15C shows the positioning mechanism 310 assuming an intermediate state in transition from the first state to the second state in which the IR filter 302 is in transition from out of the optical path 350 to into the optical path 350. FIG. 15D shows the positioning mechanism 310 assuming an intermediate state in transition from the second state to the first state in which the IR filter 302 is in transition from in the optical path 350 to out of the optical path 350. As the positioning mechanism 310 moves between the first and second states, the IR filter 302 is guided along the guide path 324 into position to block the lens 116 (FIG. 15C and then FIG. 15B), and then out of position to unblock the lens 116 (FIG. 15D and then FIG. 15A). The guide rails 320, 322 prevent the IR filter 302 from unwanted slipping into or out of the optical path 350 during movement by the actuator 312.

Figure 17:
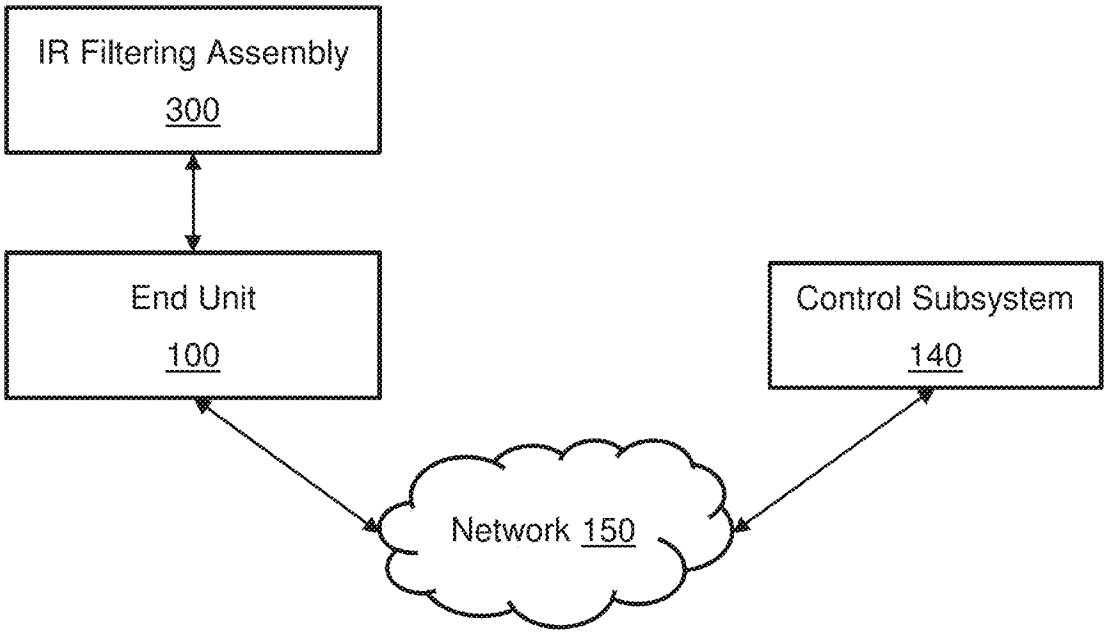
FIG. 17 is a block diagram illustrating the linkage between the end unit and the IR filter assembly.
Figure 18:
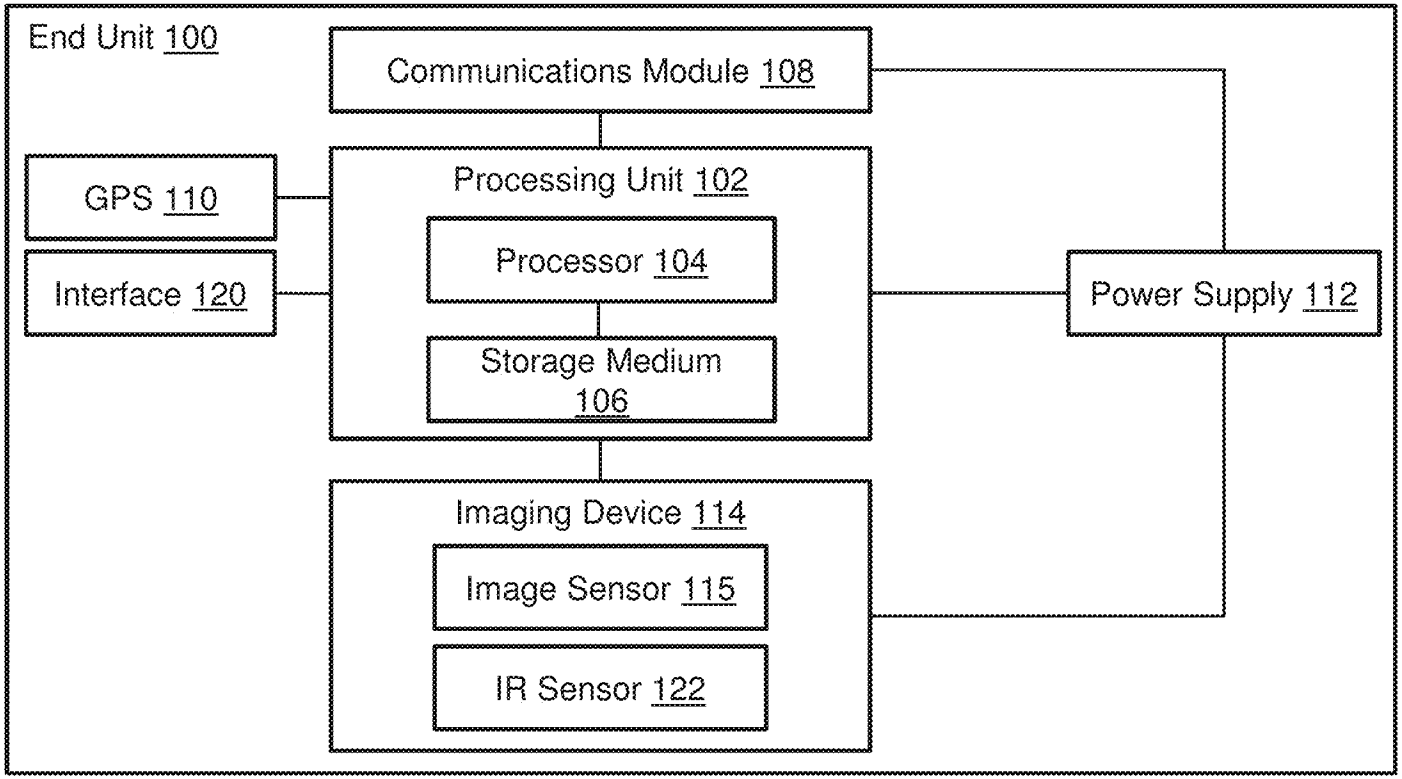
FIG. 18 is a block diagram of the components of an end unit having two image sensors that are separately used in different modes of operation of the system, according to an embodiment of the invention.

With continued reference to FIGS. 15A-16B, refer now to FIG. 17, a simplified block diagram showing the connection between the IR filtering assembly 300 and the end unit 100 and the control subsystem 140. In a non-limiting implementation, the actuator 312 is linked to the communication and processing components of the end unit 100 such that the actuator 312 can be controlled by the control subsystem 140 via the end unit 100 over the network 150. In certain embodiments, some or all of the components of the IR filter assembly 300 are mechanically attached to, or integrated as part of, the end unit 100. In other embodiments, the IR filter assembly 300 includes a dedicated receiver and processing unit for receiving commands from the control subsystem 140 over the network 150 and relaying the received commands to the actuator 312.

When the system 10 operates in calibration mode, the control subsystem 140 controls the positioning mechanism 310 to position the IR filter 302 out of the optical path 350 such that the imaging device 114 captures a full spectral image of the scene (including the target 34), where the term "full spectral image" generally refers to an image that conveys visible and IR light image components of a scene. Generally speaking, the operation of the system 10 in calibration mode in embodiments utilizing the IR filter assembly 300 is the same as the operation of the system 10 in calibration mode in embodiments without the IR filter assembly 300. As described for the embodiments corresponding to FIGS. 1-13, when the system 10 operates in calibration mode the control subsystem 140 actuates the imaging device 114 to capture an image of the scene, which includes the target 34, and actuates one or more of the processing components of the system 10 (e.g., the image processing engine 134 of the processing subsystem 132, the processing unit 102) to process (i.e., analyze) the captured image in order to identify the target 34 in the scene and extract spatial information related to (associated with) the target 34. The spatial information related to the target includes the target size/dimensions (i.e., the horizontal and vertical dimensions of the target 34) and the horizontal and vertical position of the target 34 within the scene, which together define the target coverage zone. The image processing engine 134 and/or the processing unit 102 may process the captured image by applying one or more machine vision algorithms, which allow the processing components of the system 10 to define the target coverage zone from the extracted spatial information, enabling the processing components of the system 10 to identify projectile strikes during operational mode by comparing subsequently captured images against the extracted spatial information. The spatial information extraction and identification of the target 34 in the scene may also be performed by imaging a bar code positioned near the target 34.

When the system 10 operates in operational mode, the control subsystem 140 actuates the positioning mechanism 310 to position the IR filter 302 into the optical path 350. In the illustrated embodiments, the positioning of the IR filter 302 into the portion 352 of the optical path 350 entails placement of the IR filter 302 in front of the lens 116, between the lens 116 and the scene, at a sufficient distance such that all of the light from the scene within the field of view 118 necessarily passes through the IR filter 302 before impinging on the lens 116. In practice, the distance between the IR filter 302 and the lens 116 is on the order of several millimeters (e.g., 5-25 mm). As discussed, the IR filter 302 blocks the visible light within the field of view 118 such that only the IR light within the field of view 118 reaches the image sensor 115. This deployment of the IR filter 302 in the optical path 350 effectively transforms the imaging device 114 into an IR imaging device (since the image sensor 115 is sensitive to radiation in the IR region of the electromagnetic spectrum). Once the IR filter 302 is positioned in the optical path 350, the control subsystem 140 actuates the imaging device 114 to capture a series of images (IR images) of the scene (target 34) and actuates one or more of the processing components of the system 10 (e.g., the image processing engine 134 of the processing subsystem 132, the processing unit 102) to process (i.e., analyze) the series of captured images.

The image captured based identification of projectile strikes in embodiments utilizing the IR filter assembly 300 is generally the same as in embodiments without the IR filter assembly 300. The main difference between the captured images in the present embodiments (using the IR filter assembly 300) and the captured images in the previously described embodiments (without the IR filter assembly 300) is that the captured images of the present embodiments are IR images—since only the IR light from the scene is successfully passed through the IR filter 302 to the image sensor 115. As described for the embodiments corresponding to FIGS. 1-13, when the system 10 operates in operational mode the image processing engine 134 and/or the processing unit 102 compare individual images in the series of images with one or more other images in the series of images to identify changes in the scene. These identified changes are correlated with the target coverage zone, defined from extracted spatial information during calibration mode, to identify projectile strikes on the target 34. For example, the image processing engine 134 and/or the processing unit 102 detect a projectile strike on the target 34 in response to identifying a change in the portion of the scene that corresponds to the target coverage zone, whereby the change in the portion of the scene is identified via comparison between images in the series of images.

The control subsystem 140 is preferably configured to display the image of the target 34 captured during calibration mode on a display device coupled to the control subsystem 140. In implementations in which the control subsystem 140 is implemented as a management application 242 executed on a mobile communication device 240 (FIG. 13), the image of the target 34 is displayed on the display area 244 of the display unit of the mobile communication device 240. In addition, the control subsystem 140 is preferably configured to overlay projectile strike information extracted from the series of images captured by the imaging device 114 during operational mode. The projectile strike information is extracted from the series of images by the image processing engine 134 and/or the processing unit 102, and is represented for display to the user of the system 10 as demarcations, for example, dots, overlaid on the image of the target 34.

It is noted that the IR filter assembly 300 can be deployed in various configurations. For example, in certain non-limiting implementations the IR filter assembly 300 is deployed with the actuator 312 positioned below the imaging device 114 and with the guide rails 320, 322 vertically oriented such that the IR filter 302 essentially moves in a vertical fashion to block and unblock the lens 116. In such implementations, the majority of the motion of the IR filter 302 is in the vertical direction (for example, as illustrated in FIGS. 16A and 16B). In other implementations, the IR filter assembly 300 is deployed with the actuator 312 adjacent to the imaging device 114 and with the guide rails 320, 322 horizontally oriented such that the IR filter 302 essentially moves in a horizontal fashion to block and unblock the lens 116. In such implementations, the majority of the motion of the IR filter 302 is in the horizontal direction. In yet other implementations, the IR filter assembly 300 is deployed with the actuator 312 off-axis relative to the vertical/horizontal directions of the imaging device 114 and with the guide rails 320, 322 oriented at a corresponding angle relative to the vertical/horizontal directions.

Although the embodiments of the IR positioning assembly described thus far have pertained to deployment of an IR filter external to the imaging device 114 such that the IR filter is selectively positionable in a portion 352 of the optical path 350 between the scene and the lens 116 (i.e., in front of the lens 116), other embodiments are possible in which the positioning mechanism 310 and the IR filter 302 are deployed inside of the imaging device 114 so as to enable positioning of the IR filter 302 in and out of an optical path portion 354 between the imaging lens 116 and the image sensor 115. As should be apparent, in such embodiments, the IR filter 302 is positionable in back of the lens 116 and the guiding arrangement should also be attached to an internal portion of the housing of the imaging device 114 at the back of the lens 116.

As alluded to above, according to certain embodiments the image sensor 115 and the IR sensor 122 may be used in tandem, whereby the image sensor 115 is used when the system 10 operates in calibration mode, and the IR sensor 122 is used when the system 10 operates in operational mode. FIG. 20 illustrates a generalized block diagram of the end unit 100 according to such embodiments. Although preferably the two image sensors 115, 122 are housed together in a single imaging device 114 (as shown in FIG. 20), the present embodiments include variations in which the image sensor 115 and the IR sensor 122 are housed in separate imaging devices.

In embodiments which employ using the image sensor 115 and the IR sensor 122 in tandem, when the system 10 operates in calibration mode the control subsystem 140 actuates the imaging device that houses the image sensor 115 to capture an image of the scene (that includes the target 34) using the image sensor 115. The captured image of the scene includes at least a visible light image, and may also include IR image information if the image is a full spectral image (e.g., if the dichroic filter of the imaging device has been removed or disabled). As discussed for the previously described embodiments, the control subsystem 140 then actuates one or more of the processing components of the system 10 (e.g., the image processing engine 134, the processing unit 102) to process (i.e., analyze) the captured image in order to identify the target 34 in the scene and extract spatial information related to (associated with) the target 34.

When the system 10 operates in operational mode the control subsystem 140 actuates the imaging device that houses the IR sensor 122 to capture a series of IR images of the scene (target 34) using the IR sensor 122. The control subsystem 140 then actuates one or more of the processing components of the system 10 (e.g., the image processing engine 134, the processing unit 102) to process (i.e., analyze) the series of captured IR images to detect projectile strikes on the target 34, as discussed in the previously described embodiments.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. As discussed above, the data management application 242 may be implemented as a plurality of software instructions or computer readable program code executed on one or more processors of a mobile communication device. As such, in an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, non-transitory storage media such as a magnetic hard-disk and/or removable media, for storing instructions and/or data. Optionally, a network connection is provided as well. A display and/or a user input device such as a keyboard or mouse are optionally provided as well.

For example, any combination of one or more non-transitory computer readable (storage) medium(s) may be utilized in accordance with the above-listed embodiments of the present invention. The non-transitory computer readable (storage) medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

The block diagrams in the drawings illustrate the architecture, functionality, and operation of possible implementations of systems, devices, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

As used herein, the singular form, "a", "an" and "the" include plural references unless the context clearly dictates otherwise.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

The processes (methods) and systems, including components thereof, herein have been described with exemplary reference to specific hardware and software. The processes (methods) have been described as exemplary, whereby specific steps and their order can be omitted and/or changed by persons of ordinary skill in the art to reduce these embodiments to practice without undue experimentation. The processes (methods) and systems have been described in a manner sufficient to enable persons of ordinary skill in the art to readily adapt other hardware and software as may be needed to reduce any of the embodiments to practice without undue experimentation and using conventional techniques.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A firearm training system, comprising:

an end unit comprising an imaging device for capturing images of a scene, the imaging device having an image sensor and at least one lens defining an optical path from the scene to the image sensor, and the end unit being positionable against a target;

at least one processor operatively coupled to the end unit;

an infrared filter;

a positioning mechanism operatively coupled to the infrared filter, the positioning mechanism configured to position the infrared filter in and out of the optical path; and a control subsystem linked to the end unit, the at least one processor, and the positioning mechanism, wherein the control subsystem is configured to control the end unit, the at least one processor, and the positioning mechanism to effect switching of the firearm training system between a first mode and a second mode, wherein when in the first mode, in response to actuation by the control subsystem:

the positioning mechanism positions the infrared filter out of the optical path, the imaging device captures at least one image of the scene, and the at least one processor analyzes the at least one image of the scene captured by the imaging device to identify the target in the at least one captured image and to extract spatial information associated with the target, and wherein when in the second mode, in response to actuation by the control subsystem:

the positioning mechanism positions the infrared filter in the optical path, the imaging device captures a series of images of the scene with the infrared filter positioned in the optical path, and the at least one processor analyzes the captured series of images of the scene to identify firearm projectile strikes on the target based in part on: comparisons between images from the series of images, and the extracted spatial information.

2. The firearm training system of claim 1, wherein the target is a physical target.

3. The firearm training system of claim 1, wherein the end unit is positionable against a background having images displayed thereon corresponding to at least one virtual target.

4. The firearm training system of claim 1, wherein the positioning mechanism is configured to position the infrared filter between the scene and the at least one lens.

5. The firearm training system of claim 1, wherein the positioning mechanism is configured to position the infrared filter between the at least one lens and the image sensor.

6. The firearm training system of claim 1, wherein the positioning mechanism generates circular to linear motion for moving the infrared filter in and out of the optical path.

7. The firearm training system of claim 1, further comprising: a guiding arrangement in operative cooperation with the infrared filter and defining a guide path along which the infrared filter is configured to move, such that the infrared filter is guided along the guide path and passes in front of the at least one lens so as to be positioned in the optical path when the positioning mechanism is actuated by the control subsystem.

8. The firearm training system of claim 1, wherein the firearm projectiles are live ammunition projectiles.

9. The firearm training system of claim 1, wherein the firearm projectiles are light beams emitted by a light source emanating from a firearm.

10. The firearm training system of claim 1, wherein the end unit includes the at least one processor.

11. The firearm training system of claim 1, wherein the at least one processor is deployed as part of a server remotely located from the end unit and linked to the end unit over a network.

12. The firearm training system of claim 1, wherein the control subsystem is configured to display the identified target in the at least one image of the scene captured by the imaging device in the first mode, and is further configured to overlay information, extracted from the series of images captured by the imaging device in the second mode, on the displayed identified target in the at least one image of the scene.

13. A firearm training system, comprising:

an end unit comprising a first image sensor for capturing at least a visible light image of a scene, and a second image sensor for capturing an infrared image of the scene, the end unit being positionable against a target;

at least one processor operatively coupled to the end unit; and a control subsystem linked to the end unit and the at least one processor, wherein the control subsystem is configured to control the end unit and the at least one processor to effect switching of the firearm training system between a first mode and a second mode, wherein when in the first mode, in response to actuation by the control subsystem:

the first image sensor captures at least one visible light image of the scene, and the at least one processor analyzes the at least one image of the scene captured by the image sensor to identify the target in the at least one captured image and to extract spatial information associated with the target, and wherein when in the second mode, in response to actuation by the control subsystem:

the second image sensor captures a series of infrared images of the scene, and the at least one processor analyzes the captured series of infrared images of the scene to identify firearm projectile strikes on the target based in part on: comparisons between infrared images from the series of infrared images, and the extracted spatial information.

14. The firearm training system of claim 13, wherein the firearm projectiles are live ammunition projectiles.

15. The firearm training system of claim 13, wherein the firearm projectiles are light beams emitted by a light source emanating from a firearm.

16. The firearm training system of claim 13, wherein the at least one processor is deployed as part of a server remotely located from the end unit and in communication with the end unit over a network.

17. A firearm training method, comprising:

deploying at least one image sensor relative to a target;

capturing, by at least one image sensor, at least one visible light image of a scene;

analyzing, by at least one processor, the at least one image of the scene captured by the at least one image sensor to identify the target in the at least one captured image of the scene and to extract spatial information associated with the target;

capturing a series of infrared images of the scene; and analyzing, by the at least one processor, the captured series of infrared images of the scene to identify projectile strikes on the target based in part on: comparisons between infrared images from the series of infrared images, and the extracted spatial information.

18. The firearm training method of claim 17, further comprising: displaying the identified target; and overlaying information, extracted from the captured series of infrared images, on the displayed identified target.

19. The firearm training method of claim 17, wherein the at least one image sensor includes a first image sensor for capturing at least visible light images of the scene, and a second image sensor for capturing infrared images of the scene, and wherein the series of infrared images of the scene are captured by the second image sensor.

20. The firearm training method of claim 17, wherein the at least one image sensor includes exactly one image sensor that is sensitive to light in the visible region and infrared region of the electromagnetic spectrum and that is part of an imaging device having at least one lens defining an optical path from the scene to the image sensor, and wherein the firearm training method further comprises: positioning an infrared filter in the optical path prior to capturing the series of infrared images.

* * * * *